US009971260B2

(12) United States Patent
Nozaki et al.

(10) Patent No.: US 9,971,260 B2
(45) Date of Patent: May 15, 2018

(54) TONER, DEVELOPING DEVICE, AND PROCESS CARTRIDGE

(71) Applicants: Tsuyoshi Nozaki, Osaka (JP); Yoshimichi Ishikawa, Hyogo (JP); Tomoharu Miki, Osaka (JP); Yuta Takeuchi, Hyogo (JP)

(72) Inventors: Tsuyoshi Nozaki, Osaka (JP); Yoshimichi Ishikawa, Hyogo (JP); Tomoharu Miki, Osaka (JP); Yuta Takeuchi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/270,655

(22) Filed: Sep. 20, 2016

(65) Prior Publication Data

US 2017/0010548 A1 Jan. 12, 2017

Related U.S. Application Data

(63) Continuation of application No. 14/573,013, filed on Dec. 17, 2014, now abandoned.

(30) Foreign Application Priority Data

Jan. 15, 2014 (JP) ..... 2014-005136

(51) Int. Cl.
*G03G 9/08* (2006.01)
*G03G 9/087* (2006.01)
(Continued)

(52) U.S. Cl.
CPC ..... *G03G 9/0825* (2013.01); *G03G 9/0804* (2013.01); *G03G 9/0819* (2013.01); *G03G 9/0827* (2013.01); *G03G 9/08724* (2013.01); *G03G 9/08755* (2013.01); *G03G 9/08782* (2013.01); *G03G 9/09733* (2013.01); *G03G 15/08* (2013.01)

(58) Field of Classification Search
CPC .. G03G 9/0825; G03G 9/0821; G03G 9/0827; G03G 9/0819; G03G 9/09733
See application file for complete search history.

(56) References Cited

U.S. PATENT DOCUMENTS 5,176,978 A 1/1993 Kumashiro
6,096,468 A 8/2000 Ohno
(Continued)

FOREIGN PATENT DOCUMENTS

JP 2004-295105 10/2004
JP 2005-010672 1/2005
(Continued)

*Primary Examiner* — Christopher D Rodee
(74) *Attorney, Agent, or Firm* — Oblon, McClelland, Maier & Neustadt, L.L.P.

(57) ABSTRACT

A toner is provided. The toner includes toner particles each including a binder resin and a release agent. From 20% to 80% by number of the toner particles satisfy the following formula (1) and (2):

$$2/3 \leq T/Dv \leq 1.5 \quad (1)$$

$$1/3 \leq R/Dv \leq 1.0 \quad (2)$$

wherein Dv represents a volume average particle diameter of the toner particles; and T and R represent the longest cross-sectional diameters of each toner particle and the release agent contained therein, respectively, measured by observing cross-sections of the toner particles with scanning transmission electron microscope.

7 Claims, 5 Drawing Sheets

(51) Int. Cl.
*G03G 9/097* (2006.01)
*G03G 15/08* (2006.01)

(56) References Cited

U.S. PATENT DOCUMENTS

| | | | |
|---|---|---|---|
| 6,528,224 | B2 | 3/2003 | Ohno |
| 2006/0204882 | A1 | 9/2006 | Nozaki et al. |
| 2006/0210902 | A1 | 9/2006 | Nakamura et al. |
| 2007/0059625 | A1 | 3/2007 | Yamamoto et al. |
| 2007/0122729 | A1 | 5/2007 | Katoh et al. |
| 2007/0148568 | A1 | 6/2007 | Kadota et al. |
| 2007/0166635 | A1 | 7/2007 | Yamamoto et al. |
| 2007/0190442 | A1 | 8/2007 | Nakamura et al. |
| 2007/0190443 | A1 | 8/2007 | Hagi et al. |
| 2007/0207399 | A1 | 9/2007 | Kadota et al. |
| 2007/0212630 | A1 | 9/2007 | Yasunaga et al. |
| 2007/0217842 | A1 | 9/2007 | Kato et al. |
| 2007/0218384 | A1 | 9/2007 | Matsumoto et al. |
| 2007/0218388 | A1 | 9/2007 | Kurose et al. |
| 2007/0218390 | A1 | 9/2007 | Nozaki et al. |
| 2007/0218393 | A1 | 9/2007 | Nozaki et al. |
| 2007/0238042 | A1 | 10/2007 | Yasunaga et al. |
| 2008/0032223 | A1 | 2/2008 | Yamamoto et al. |
| 2008/0063957 | A1 | 3/2008 | Murakami et al. |
| 2008/0069598 | A1 | 3/2008 | Murakami et al. |
| 2008/0069617 | A1 | 3/2008 | Matsumoto et al. |
| 2008/0076054 | A1 | 3/2008 | Nozaki et al. |
| 2008/0081273 | A1 | 4/2008 | Murakami et al. |
| 2008/0096119 | A1 | 4/2008 | Yamamoto et al. |
| 2008/0124635 | A1 | 5/2008 | Nakamura et al. |
| 2008/0131797 | A1 | 6/2008 | Ishikawa et al. |
| 2008/0176159 | A1 | 7/2008 | Matsumoto et al. |
| 2008/0220357 | A1 | 9/2008 | Nozaki et al. |
| 2008/0227001 | A1 | 9/2008 | Kadota et al. |
| 2008/0227013 | A1 | 9/2008 | Kadota et al. |
| 2008/0227016 | A1 | 9/2008 | Nozaki et al. |
| 2008/0232857 | A1 | 9/2008 | Matsumoto et al. |
| 2008/0233497 | A1 | 9/2008 | Yamamoto et al. |
| 2008/0233510 | A1 | 9/2008 | Nozaki et al. |
| 2008/0233511 | A1 | 9/2008 | Ishikawa et al. |
| 2008/0279591 | A1 | 11/2008 | Yasunaga et al. |
| 2009/0017391 | A1 | 1/2009 | Yamamoto et al. |
| 2009/0186289 | A1 | 7/2009 | Nakamura et al. |
| 2009/0220879 | A1 | 9/2009 | Matsumoto et al. |
| 2009/0232542 | A1 | 9/2009 | Yamamoto et al. |
| 2009/0233199 | A1 | 9/2009 | Nozaki et al. |
| 2009/0257792 | A1 | 10/2009 | Nakamura et al. |
| 2009/0297975 | A1 | 12/2009 | Ishikawa et al. |
| 2009/0297976 | A1 | 12/2009 | Yamamoto et al. |
| 2010/0055603 | A1 | 3/2010 | Nozaki et al. |
| 2010/0150609 | A1 | 6/2010 | Nozaki et al. |
| 2010/0239974 | A1 | 9/2010 | Nozaki et al. |
| 2011/0045401 | A1 | 2/2011 | Murakami et al. |
| 2011/0053063 | A1 | 3/2011 | Kadota et al. |
| 2011/0053071 | A1 | 3/2011 | Miki et al. |
| 2011/0053077 | A1 | 3/2011 | Mikuriya et al. |
| 2011/0164901 | A1 | 7/2011 | Yamamoto et al. |
| 2011/0217644 | A1 | 9/2011 | Yamamoto et al. |
| 2011/0250533 | A1 | 10/2011 | Kadota et al. |
| 2011/0287356 | A1 | 11/2011 | Fukao et al. |
| 2012/0219321 | A1 | 8/2012 | Fukao et al. |
| 2012/0219326 | A1* | 8/2012 | Koike ..... G03G 15/0893 399/254 |
| 2012/0237253 | A1 | 9/2012 | Fukao et al. |
| 2012/0237267 | A1 | 9/2012 | Fukao et al. |
| 2012/0251938 | A1 | 10/2012 | Yamamoto et al. |
| 2012/0264048 | A1 | 10/2012 | Ishikawa et al. |
| 2013/0029260 | A1 | 1/2013 | Nozaki et al. |
| 2013/0344427 | A1 | 12/2013 | Kadota et al. |
| 2014/0038095 | A1 | 2/2014 | Ishikawa et al. |
| 2014/0050504 | A1 | 2/2014 | Fukao et al. |
| 2014/0147779 | A1 | 5/2014 | Fuwa et al. |
| 2014/0147780 | A1 | 5/2014 | Nozaki et al. |
| 2014/0147784 | A1 | 5/2014 | Kadota et al. |

FOREIGN PATENT DOCUMENTS

| | | |
|---|---|---|
| JP | 2005-084183 | 3/2005 |
| JP | 2005-099079 | 4/2005 |
| JP | 2006-337902 | 12/2006 |
| JP | 2007-033696 | 2/2007 |
| JP | 2008-089670 | 4/2008 |
| JP | 2008-262172 | 10/2008 |
| JP | 2010-085969 | 4/2010 |

* cited by examiner

TONER, DEVELOPING DEVICE, AND PROCESS CARTRIDGE

CROSS-REFERENCE TO RELATED APPLICATIONS

This application is is a continuation application of prior U.S. application Ser. No. 14/573,013, filed Dec. 17, 2014, the disclosure of which is incorporated herein by reference in its entirety. The parent application claims priority pursuant to 35 U.S.C. § 119(a) to Japanese Patent Application No. 2014-005136, filed on Jan. 15, 2014, in the Japan Patent Office, the disclosure of which is incorporated herein by reference in its entirety.

BACKGROUND

Technical Field

The present disclosure relates to a toner for developing electrostatic charge image in electrophotography, electrostatic recording, electrostatic printing, etc., and a developing device and a process cartridge using the toner.

Description of the Related Art

Electrophotography is still under research and development through various inventive and technical approaches. In electrophotography, an image is generally formed by charging and irradiating the surface of photoconductor to form an electrostatic latent image, developing the electrostatic latent image into a toner image with colored toner, transferring the toner image onto a transfer medium such as paper, and fixing the toner image on the transfer medium by a heat roller, etc.

As methods for fixing toner, contact heat fixing methods, such as heat roller fixing method, are widely employed. Fixing devices for use in heat roller fixing method are generally equipped with a heat roller and a pressure roller. A recording sheet having a toner image thereon is allowed to pass the pressure-contact point of the heat roller with the pressure roller (i.e., the nip portion) so that the toner image can be melted and fixed on the recording sheet.

Resins for use in toner are generally selected from vinyl polymeric resins and polyester-backbone resins. These resins have both advantages and disadvantages in terms of flowability, mobility, chargeability, fixability, and image property. Nowadays, combined resins in which both kinds of these resins are combined and hybrid resins having both of these backbones are being used. As methods for producing toner other than conventional knead-pulverization method, the following methods are known: suspension method and emulsification method, both using an organic solvent and an aqueous solvent; suspension polymerization method that directly produces toner particles by controlling polymerizable monomer droplets; and aggregation method that produces toner particles by aggregating emulsified fine particles. These methods are called wet granulation methods or chemical toner methods.

The contact heat fixing methods can achieve energy saving as the heating temperature is lowered as much as possible. Accordingly, resins which are meltable at low temperatures are suitable for toner for use in the contact heat fixing methods. On the other hand, electrophotography has a process in which toner is mechanically or thermally stressed. Thus, the resins should be limited in thermal properties, such as glass transition temperature, so as not to cause toner blocking. The resins should also be limited in molecular weight so as not to cause toner cracking. Although such limited thermal properties and molecular weight generally do not go together, toner is required to achieve a good balance therebetween. In view of this, core-shell toners have been proposed in which an inner resin having an advantageous property for fixing is covered with an outer resin having an advantageous property for avoiding toner blocking.

In addition, core-shell toners which use polyester resins are also known. Polyester resins are generally advantageous in terms of toughness, heat resistance, and fixability.

In order not to expose release agent at the surface of toner and to maximize the exuding efficiency of the release agent when the toner is being fixed, it is preferable that the release agent have a spherical shape. So long as the release agent is contained within the toner, it is also preferable that the release agent has a larger particle diameter.

SUMMARY

In accordance with some embodiments, a toner is provided. The toner includes toner particles each including a binder resin and a release agent. A first amount of the toner particles satisfy the following formula (1) and a second amount of the toner particles satisfies the following formula (2). A ratio of the second amount of toner particles to the first amount of toner particles is from 20% to 80% by number:

$$2/3 \leq T/Dv \leq 1.5 \quad (1)$$

$$1/3 \leq R/Dv \leq 1.0 \quad (2)$$

wherein Dv represents a volume average particle diameter of the toner particles; and T and R represent the longest cross-sectional diameters of each toner particle and the release agent contained therein, respectively, measured by observing cross-sections of the toner particles with scanning transmission electron microscope.

In accordance with some embodiments, a developing device is provided. The developing device includes a developer bearer and a developer supply member. The developer bearer bears the above toner to be supplied to a latent image bearer. The developer supply member supplies the toner to a surface of the developer bearer.

In accordance with some embodiments, a process cartridge detachably mountable on image forming apparatus is provided. The process cartridge includes a latent image bearer that bears a latent image and the above developing device that develops the latent image with the toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
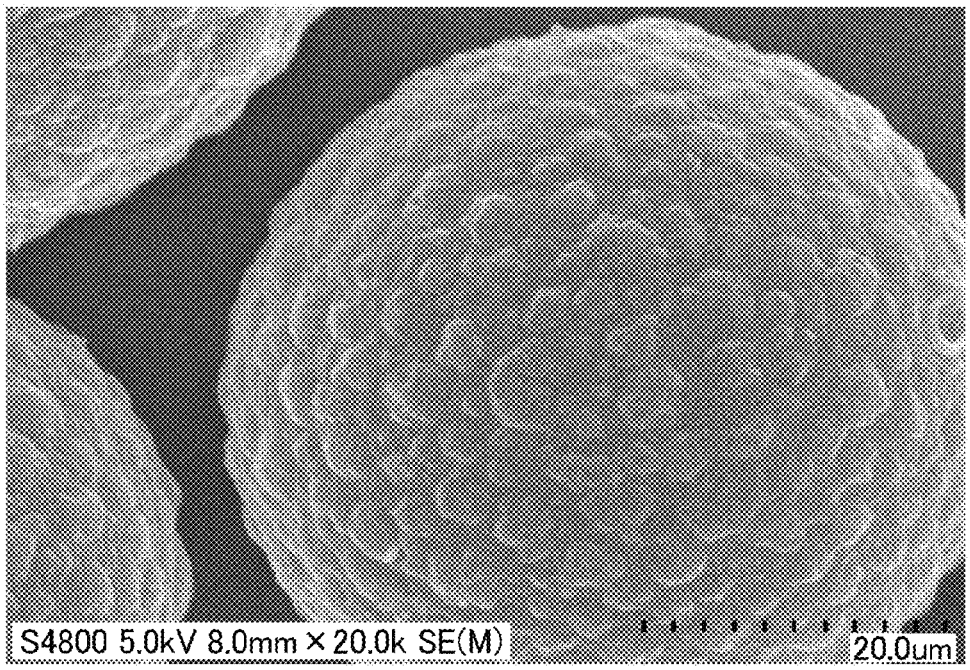
FIG. 1 is a surface image of the toner according to an embodiment of the present invention, obtained with scanning electron microscope (SEM)

One object of the present invention is to provide a toner which can achieve a good balance between fixability and developing durability.

In accordance with an embodiment of the present invention, a toner is provided which can maintain good fixability while maintaining durability such that developing members are not contaminated with release agent exuded from the toner for an extended period of time. Namely, the toner can achieve a good balance between fixability and developing durability.

Here, developing durability is defined as a property such that developability does not deteriorate. A situation where developability does not deteriorate refers to a situation where defective image is not produced even after a long-term use.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

The toner according to an embodiment of the present invention includes toner particles each including a binder resin and a release agent. The toner further specifies the ratio of toner particles containing large-particle-diameter release agent particles.

To make the toner express fixability, in particular, releasability, it is important that the release agent exude from the toner efficiently. To make the release agent exude from the toner as efficient as possible, it is important that the particle diameter and shape of the release agent in the toner be properly controlled. The inventors of the present invention have discovered that as the particle diameter of the release agent in the toner becomes larger, the release agent exudes from the toner more efficiently. On the other hand, as the particle diameter of the release agent in the toner particle becomes larger, the exposure ratio of the release agent at the surface of the toner particle becomes inevitably lower. When such a toner particle containing large-particle-diameter release agent particles is fixed on a recording medium, a part of the release agent particles existing near the surface of the toner particle will exude first and all the release agent particles will consequently exude therefrom in an efficient manner. However, the toner particle containing large-particle-diameter release agent particles inevitably contains an excessive amount of the release agent. The toner as a whole contains the release agent in an amount more than necessary and is likely to cause developing members to be contaminated with the release agent.

The toner according to an embodiment of the present invention is controlled such that only a necessary amount of toner particles contain the release agent in the ideal condition and the other toner particles contain no release agent. As a result, the toner as a whole suppresses developing members from being contaminated with the release agent. The toner particles containing the release agent in the ideal condition express releasability when the toner is being fixed on a recording medium. Thus, a functionally-separated toner that achieves a good balance between fixability and developing durability is provided.

The toner according to an embodiment of the present invention is defined in terms of condition of the release agent contained therein.

In particular, when cross sections of the toner particles are observed with a scanning electron microscope (STEM) to measure the longest cross-sectional diameters, a first amount of the toner particles satisfies the following formula (1) and a second amount of the toner particles satisfies the following formula (2). A ratio of the second amount of toner particles to the first amount of toner particles is from 20% to 80% by number.

$$2/3 \leq T/Dv \leq 1.5 \quad (1)$$

$$1/3 \leq R/Dv \leq 1.0 \quad (2)$$

wherein Dv represents a volume average particle diameter of the toner particles; and T and R represent the longest cross-sectional diameters of each toner particle and the release agent contained therein, respectively, measured by observing cross-sections of the toner particles with scanning transmission electron microscope.

When the ratio of the second amount of toner particles to the first amount of toner particles is less than 20% by number, the resulting fixed image is likely to have local portions where toner particles from which little amount of the release agent has exuded are aggregated. Such portions are likely to cause offset problem, which is not preferable. When the ratio of the second amount of toner particles to the first amount of toner particles exceeds 80% by number, it is likely that developing members and photoconductors are contaminated with the release agent bled out from toner particles to produce defective image, which is not preferable. Accordingly, the preferable ratio of the second amount of toner particles to the first amount of toner particles is from 20% to 80% by number, more preferably from 40% to 80% by number, and most preferably from 60% to 80% by number.

The release agent contained in each cross-section of the toner particles preferably has a shape factor SF-1 of from 100 to 140, more preferably from 100 to 130. When SF-1 exceeds 140, it is likely that a part of the release agent is exposed at the surface of the toner particle and that developing members and photoconductors are contaminated with the release agent, which is not preferable. On the other hand, as the shape of the toner particle comes closer to sphere, exposure of the release agent at the surface of the toner particle is more suppressed. Therefore, the toner particles preferably have an average circularity of 0.96 or more, more preferably 0.97 or more.

To make SF-1 of the cross-sectional shape of the release agent fall within the above-described range, it is preferable that the toner use a release-agent-containing resin. When the release agent is pulverized in such a typical way that the release agent is dispersed in an aqueous medium or organic solvent and pulverized into small pieces having a size of several μm by means of bead mill, etc., the pieces of the release agent will have a needle-like or disc-like shape, which is not suitable for satisfying the above-described requirements for the cross-sectional shape of the release agent.

To suppress exposure of the release agent at the surface of the toner particle as much as possible, it is preferable that the shape of the release agent be close to sphere as much as possible. To contain large-size release agent particles in the toner particle, it is preferable that the shape of the toner particle also be close to sphere as much as possible.

A toner satisfying the above-described requirements for the particle diameter and shape of the release agent can be preferably obtained by chemical methods. In particular, such a functionally-separated toner can be preferably obtained by dissolution suspension method. It is difficult for conventional knead-pulverization method to control the shape of release agent be spherical because of having high-temperature kneading process. In chemical methods other than dissolution suspension method, the particle diameter of release agent may be controllable but the dispersion state of release agent may be uncontrollable, resulting in production of toner particles containing an excessive amount of release agent. By contrast, in dissolution suspension method, release agent particles having desired shape and particle diameter are previously dispersed in an oily phase, and the oily phase is split into small oil droplets without further splitting the release agent particles. The small oil droplets are formed into toner particles with a core of the release agent, forming functionally-separated toner particles.

Structure and composition of near-surface region of mother toner particle greatly influence chargeability, fixability, and durability of the toner. With respect to core-shell toner, the shell layer is serving as the near-surface region. In the toner according to an embodiment of the present invention, fine resin particles are optionally included in the toner to form the near-surface region. Unlike a related-art core shell toner in which the shell layer is covering over the core, the fine-resin-particles portion, serving as the near-surface region, of the toner according to an embodiment of the present invention do not avoid the core resin and release agent from exuding from the toner when the toner is being fixed.

According to an embodiment of the present invention, each fine resin particle is half embedded in the toner particle to form a projection. Thus, the toner particles will be brought into contact with developing members or photoconductor at limited portions, i.e., the projections. This results in protection of the core, having good fixability and poor durability, and further results in improvement of the toner as a whole in terms of durability. FIG. 1 is a surface image of the toner according to an embodiment of the present invention, obtained with scanning electron microscope (SEM). According to FIG. 1, a plurality of fine resin particles, each composed of a vinyl polymeric resin, is present on the surface of the mother toner particle forming a sea-island structure in which the fine resin particles serve as island portions and the other constituents serve as sea portions. Even with such a configuration, it is problematic in terms of durability if the release agent is exposed at the surface of the toner particle. The release agent should be encapsulated in the toner particle. In a case in which the toner is required to be fixable at much higher speed in accordance with an increase in system speed, the release agent should exude from the toner particle more efficiently. The toner is required to achieve a higher degree of balance between such properties. One approach for improving developability and durability includes forming projections with fine particles serving as the shell layer.

Binder Resin

In accordance with some embodiments of the present invention, the binder resin preferably includes a polyester resin because it has an advantage in fixability. Further, the binder resin also preferably includes a vinyl polymeric resin because it has an advantageous structure for encapsulating release agent. In particular, a polyester-vinyl polymeric hybrid resin is preferable because it has a good dispersibility in polyester resin and an advantage in fixability.

Crystalline Resin and Amorphous Resin

The toner according to an embodiment of the present invention may include not only an amorphous resin but also a crystalline resin. It is preferable that the amorphous and crystalline resins are incompatible with and independent from each other with the crystalline resin being present in the core particle until the toner is fixed on a recording medium. For the same reason described above, in particular, a crystalline polyester resin is preferable.

Fine Resin Particles

It is preferable that fine resin particles be present on the surface of the mother toner particle to improve durability and developability. The fine resin particles are required not to be compatible with the surface resin of the mother toner particle (i.e., the core particle) or not to coalesce with each other, so as not to be formed into a shell layer which will cover over the mother toner particle. To meet such requirements, a styrene-acrylic resin is preferably used for the fine resin particles because it is incompatible with polyester resin that is composing the core particle, as well as it has an advantage in chargeability.

Polyester Resin

Usable polyester resins include polycondensation products of polyols (1) with polycarboxylic acids (2) listed below, but are not limited thereto. Two or more polyester resins can be used in combination.

Polyol

Specific examples of polyols (1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, ethylene glycol, propylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (as known as tetrafluorobisphenol A), and 2,2-bis(3-hydroxyphenyl)-1,1,1,3,3,3-hexafluoropropane; bis(4-hydroxyphenyl) ethers such as bis(3-fluoro-4-hydroxyphenyl) ether; alkylene oxide (e.g., ethylene oxide, propylene oxide, butylene oxide) adducts of the above-described alicyclic diols; and alkylene oxide (e.g., ethylene oxide, propylene oxide, butylene oxide) adducts of the above-described bisphenols.

Among these polyols, alkylene glycols having a carbon number of from 2 to 12 and alkylene oxide adducts of bisphenols are preferable, and combination use of alkylene oxide adducts of bisphenols with alkylene glycols having a carbon number of from 2 to 12 is more preferable.

Specific examples of polyols (1) further include, but are not limited to, polyvalent aliphatic alcohols having 3 or more valences (e.g., glycerin, trimethylolethane, trimethylolpropane, pentaerythritol, sorbitol); phenols having 3 or more valences (e.g., trisphenol PA, phenol novolac, cresol novolac); and alkylene oxide adducts of the polyphenols having 3 or more valences.

Each of these polyols can be used alone or in combination with others.

Polycarboxylic Acid

Specific examples of polycarboxylic acids (2) include, but are not limited to, alkylene dicarboxylic acids (e.g., succinic acid, adipic acid, sebacic acid); alkenylene dicarboxylic acids (e.g., maleic acid, fumaric acid); and aromatic dicarboxylic acids (e.g., phthalic acid, isophthalic acid, terephthalic acid, naphthalenedicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, hexafluoroisopropylidene diphthalic acid anhydride).

Among these polycarboxylic acids, alkenylene dicarboxylic acids having a carbon number of from 4 to 20 and aromatic dicarboxylic acids having a carbon number of from 8 to 20 are preferable. Specific examples of polycarboxylic acids (2) to be reacted with the polyols (1) further include, but are not limited to, polycarboxylic acids having 3 or more valences, such as aromatic polycarboxylic acids having a carbon number of from 9 to 20 (e.g., trimellitic acid, pyromellitic acid); and acid anhydrides or lower alkyl esters (e.g., methyl ester, ethyl ester, isopropyl ester) of the above-described polycarboxylic acids. Each of these polycarboxylic acids can be used alone or in combination with others.

Ratio Between Polyol and Polycarboxylic Acid

The equivalent ratio [OH]/[COOH] of hydroxyl groups [OH] in the polyol (1) to carboxyl groups [COOH] in the polycarboxylic acid (2) is typically from 2/1 to 1/1, preferably from 1.5/1 to 1/1, and more preferably from 1.3/1 to 1.02/1.

Molecular Weight of Polyester Resin

The polyester resin has a molecular weight distribution such that a peak is observed within a range of from 1,000 to 30,000, preferably from 1,500 to 10,000, and more preferably from 2,000 to 8,000. When the peak molecular weight is less than 1,000, heat-resistant storage stability worsens. When the peak molecular weight exceeds 30,000, low-temperature fixability worsens.

Modified Polyester Resin

The binder resin may include a modified polyester resin having urethane and/or urea group for the purpose of adjusting viscoelasticity. The content rate of the modified polyester resin having urethane and/or urea group is preferably 20% by weight or less, more preferably 15% by weight or less, and most preferably 10% by weight or less, based on total weight of the binder resin. When the content rate exceeds 20% by weight, low-temperature fixability worsens. The modified polyester resin having urethane and/or urea group may be directly mixed in the binder resin. Alternatively, it is more preferable in terms of productivity that the modified polyester resin having urethane and/or urea group be produced by mixing a relatively-low-molecular-weight modified polyester resin having terminal isocyanate group (hereinafter may be referred to as "prepolymer") in the binder resin along with an amine reactive with the prepolymer, water, etc., to cause chain elongation and/or cross-linking reaction during or after granulation. By the latter method, it is possible to easily include a relatively-high-molecular-weight modified polyester resin, for adjusting viscoelasticity, in the toner.

Prepolymer

The prepolymer having an isocyanate group includes reaction products of a polyester having an active hydrogen group with a polyisocyanate (3), where the polyester is a polycondensation product of the polyol (1) with the polycarboxylic acid (2). The active hydrogen group includes hydroxyl groups (e.g., alcoholic hydroxyl groups, phenolic hydroxyl groups), amino groups, carboxyl group, and mercapto group. Among these groups, alcoholic hydroxyl groups are most preferable.

Polyisocyanate

Specific examples of the polyisocyanates (3) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, and blocked polyisocyanates in which the above polyisocyanates are blocked with phenol derivatives, oxime, or caprolactam. Two or more of these compounds can be used in combination.

Ratio Between Isocyanate Group and Hydroxyl Group

The equivalent ratio [NCO]/[OH] of isocyanate groups [NCO] in the polyisocyanate (3) to hydroxyl groups [OH] in the polyester having a hydroxyl group is typically from 5/1 to 1/1, preferably from 4/1 to 1.2/1, and more preferably from 2.5/1 to 1.5/1. When the equivalent ratio [NCO]/[OH] exceeds 5, low-temperature fixability worsens. When the molar ratio of [NCO] is less than 1, the urea content in the modified polyester is lowered to degrade hot offset resistance. The content of the polyisocyanate (3) components in the prepolymer (A) having terminal isocyanate group is typically from 0.5 to 40% by weight, preferably from 1 to 30% by weight, and more preferably from 2 to 20% by weight. When the content is less than 0.5% by weight, hot offset resistance worsens. When the content exceeds 40% by weight, low-temperature fixability worsens.

Number of Isocyanate Groups in Prepolymer

The number of isocyanate groups included in one molecule of the prepolymer (A) having an isocyanate group is typically 1 or more, preferably from 1.5 to 3 in average, and more preferably from 1.8 to 2.5 in average. When the number of isocyanate groups per molecule is less than 1, the molecular weight of the modified polyester having been cross-linked and/or elongated is lowered to degrade hot offset resistance.

Chain Elongation and/or Cross-linking Agent

Amines can be used as chain elongation and/or cross-linking agents, if necessary. The amine (B) may be, for example, a diamine (B 1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmethane, tetrafluoro-p-xylylenediamine, tetrafluoro-p-phenylenediamine), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine, dodecafluorohexylenediamine, tetracosafluorododecylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

Terminator

If needed, the chain elongation and/or cross-linking reaction may be terminated by a terminator to adjust the molecular weight of the resulting modified polyester. Specific examples of usable terminators include, but are not limited to, monoamines (e.g., diethylamine, dibutylamine, butylamine, laurylamine) and blocked monoamines (e.g., ketimine compounds).

Crystalline Polyester Resin

The toner according to an embodiment of the present invention may include a crystalline polyester to improve low-temperature fixability. The crystalline polyester includes polycondensation products of the above-described polyols with polycarboxylic acids. As the polyols, aliphatic diols are preferable, such as ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol, and 1,4-butenediol. Among these diols, 1,4-butanediol, 1,6-hexanediol, and 1,8-octanediol are more preferable, and 1,6-hexanediol is most preferable. As the polycarboxylic acids, aromatic dicarboxylic acids, such as phthalic acid, isophthalic acid, and terephthalic acid; and aliphatic carboxylic acids having a carbon number of from 2 to 8 are preferable. For the purpose of increasing crystallinity, aliphatic carboxylic acids are preferably used.

Whether a resin is crystalline or amorphous can be determined from thermal properties of the resin. For example, in DSC measurement, a resin which shows a clear endothermic peak, such as wax, is determined as a crystalline resin. A resin which shows a gentle curve due to the occurrence of glass transition is determined as an amorphous resin.

Release-agent-Containing Resin

When the toner is prepared by dissolution suspension method, a release agent dispersion liquid in which the release agent having a predetermined particle diameter is dispersed in an organic solvent can be used. Alternatively, to make the release agent have a preferable particle diameter and shape in the resulting toner, a release-agent-containing resin prepared by adding the release agent in the process of polymerizing the resin is preferably used. In the process of polymerizing the resin, the release agent is melted and formed into particles having a sphere-like shape. By using this polymerization reaction system as an oily phase, it is possible to make the resulting toner particle contain the release agent in the ideal shape. Hydrocarbon waxes are preferable as the release agent to be added because they have low melt viscosity. In particular, paraffin waxes are preferable. As the resin to be used in combination with these waxes, vinyl polymeric resins are preferable because they have similar structures to the waxes. In particular, hybrid resins of polyester resins with vinyl polymeric resins are more preferable in view of their dispersion state inside the toner and fixability of the toner. Specifically, vinyl polyester resins obtained from the following monomers are preferable: raw material monomers for a polyester resin, including alkylene oxide adducts of bisphenol A, terephthalic acid, trimellitic acid, and succinic acid; raw material monomers for a vinyl resin, including styrene and butyl acrylate; and monomers reactive with both of the monomers, including fumaric acid. To previously incorporate a wax in a resin, the resin monomers should be subjected to a reaction in the presence of the wax.

For example, it is possible that raw material monomers for a polyester resin are stirred and heated in the presence of a hydrocarbon wax and then raw material monomers for a vinyl resin are dropped therein to cause a polycondensation reaction and a radical polymerization reaction.

Fine Vinyl Resin Particles

The fine resin particles for use in the toner according to an embodiment of the present invention are preferably composed of a vinyl resin. Fine resin particles composed of a vinyl resin are obtainable by subjecting a monomer mixture including an aromatic compound having a vinyl polymerizable functional group as a main monomer component.

The content rate of the aromatic compound having a vinyl polymerizable functional group in the monomer mixture is from 80 to 100% by weight, preferably from 90 to 100% by weight, and more preferably from 95 to 100% by weight. When the content rate of the aromatic compound having a vinyl polymerizable functional group is less than 80% by weight, the resulting toner deteriorates in chargeability.

Specific examples of the vinyl polymerizable functional group in the aromatic compound include, but are not limited to, vinyl group, isopropenyl group, allyl group, acryloyl group, and methacryloyl group.

Specific examples of such monomer include, but are not limited to, styrene, α-methylstyrene, 4-methylstyrene, 4-ethylstyrene, 4-tert-butylstyrene, 4-methoxystyrene, 4-ethoxystyrene, 4-carboxystyrene and metal salts thereof, 4-styrenesulfonic acid and metal salts thereof, 1-vinylnaphthalene, 2-vinylnaphthalene, allylbenzene, phenoxyalkylene glycol acrylate, phenoxyalkylene glycol methacrylate, phenoxypolyalkylene glycol acrylate, phenoxypolyalkylene glycol methacrylate, and methoxydiethylene glycol methacrylate.

Among these monomers, styrene is preferable because it is easily available and has high reactivity and chargeability.

The monomer mixture may include a compound having both a vinyl polymerizable functional group and an acid group (hereinafter "acid monomer") in an amount of from 0 to 7% by weight. Preferably, the content rate of the acid monomer in the monomer mixture is from 0 to 4% by weight. More preferably, the monomer mixture includes no acid monomer. When the content rate of the acid monomer exceeds 7% by weight, the resulting fine vinyl resin particles have high dispersion stability. Such fine vinyl resin particles having high dispersion stability are not likely to adhere to oil droplets dispersed in an aqueous phase at normal temperatures, or, even when once adhered to the oil droplets, they are likely to release from the oil droplets through the processes of solvent removal, washing, drying, and external treatment. When the content rate of the acid monomer is 4% by weight or less, the resulting toner becomes less environmentally-variable in chargeability.

Specific examples of the acid group in the acid monomer include, but are not limited to, carboxyl group, sulfonyl group, and phosphoryl group.

Specific examples of the compound having both a vinyl polymerizable functional group and an acid group include, but are not limited to, carboxyl-group-containing vinyl monomers and salts thereof (e.g., acrylic acid, methacrylic acid, maleic acid, maleic acid anhydride, monoalkyl maleate, fumaric acid, monoalkyl fumarate, crotonic acid, itaconic acid, monoalkyl itaconate, itaconic acid glycol monoether, citraconic acid, monoalkyl citraconate, cinnamic acid), sulfonic-acid-group-containing vinyl monomers, vinyl sulfuric acid monoester and salts thereof, and phosphoric-acid-group-containing vinyl monomers and salts thereof. Among these compounds, acrylic acid, methacrylic acid, maleic acid, maleic acid anhydride, monoalkyl maleate, fumaric acid, and monoalkyl fumarate are preferable.

Fine vinyl resin particles can be obtained by one of the following methods (a) to (f).

(a) Subjecting a monomer mixture to a polymerization reaction, such as suspension polymerization, emulsion polymerization, and seed polymerization, thus obtaining a dispersion liquid of fine vinyl resin particles.
(b) Subjecting a monomer mixture to a polymerization, pulverizing the resulting resin by a mechanically-rotary or jet-propelled pulverizer, and classifying the pulverized particles.
(c) Subjecting a monomer mixture to a polymerization, preparing a resin solution by dissolving the resulting resin in a solvent, and spraying the resin solution.
(d) Subjecting a monomer mixture to a polymerization; preparing a resin solution by dissolving the resulting resin in a solvent and adding a solvent in the resin solution, or preparing a resin solution by dissolving the resulting resin in a solvent by heat and cooling the resin solution, to precipitate fine resin particles; and removing the solvent.
(e) Subjecting a monomer mixture to a polymerization, preparing a resin solution by dissolving the resulting resin in a solvent, dispersing the resin solution in an aqueous medium in the presence of a dispersant, and removing the solvent by application of heat or reduction of pressure.
(f) Subjecting a monomer mixture to a polymerization, preparing a resin solution by dissolving the resulting resin in a solvent, dissolving an emulsifier in the resin solution, and adding water in the resin solution to cause phase-transfer emulsification.

Among these methods, the method (a) is preferable because it is easy and simple and is capable of providing fine resin particles in the form of dispersion liquid, which can be smoothly used in the next process.

In the method (a), it is preferable that an aqueous medium in which the polymerization reaction is caused contains a dispersion stabilizer, and/or that polymerizable monomers include a monomer capable of giving dispersion stability to the resulting fine resin particles (i.e., reactive emulsifier), to give dispersion stability to the resulting fine vinyl resin particles. If no dispersion stabilizer and/or reactive emulsifier is used, it may not be possible to disperse the vinyl resin into fine particles at all; the resulting fine resin particles may aggregate during storage because of their poor storage stability because of their poor dispersion stability; or core particles may aggregate or coalesce in the process of adhering the fine resin particles to the core particles (to be described in detail later) because of poor dispersion stability of the fine resin particles. The resulting toner will therefore lack uniformity in particle diameter, shape, and surface profile.

The dispersion stabilizer includes surfactant and inorganic dispersant. Specific examples of the surfactant include, but are not limited to, anionic surfactants such as alkylbenzene sulfonate, α-olefin sulfonate, and phosphates; cationic surfactants such as amine salt surfactants (e.g., alkylamine salts, amino alcohol fatty acid derivatives, polyamine fatty acid derivatives, imidazoline) and quaternary ammonium salt surfactants (e.g., alkyl trimethyl ammonium salts, dialkyl dimethyl ammonium salts, alkyl dimethyl benzyl ammonium salts, pyridinium salts, alkyl isoquinolinium salts, benzethonium chloride); nonionic surfactants such as fatty acid amide derivatives and polyol derivatives; and ampholytic surfactants such as alanine, dodecyldi (aminoethyl) glycine, di(octylaminoethyl) glycine, and N-alkyl-N,N-dimethyl ammonium betaine. Specific examples of the inorganic dispersant include, but are not limited to, tricalcium phosphate, calcium carbonate, titanium oxide, colloidal silica, and hydroxyapatite.

For the purpose of adjusting molecular weight, chain transfer agents can be used in preparing the fine resin particles. In particular, alkylmercaptan-based chain transfer agents having a hydrocarbon group having a carbon number of 3 or more are preferable. Specific examples of alkylmercaptan-based hydrophobic chain transfer agents having a hydrocarbon group having a carbon number of 3 or more include, but are not limited to, butanethiol, octanethiol, decanethiol, dodecanethiol, hexadecanethiol, octadecanethiol, cyclohexylmercaptan, thiophenol, octyl thioglycolate, octyl 2-mercaptopropionate, octyl-3-mercaptopropionate, mercaptopropionic acid 2-ethylhexyl ester, octanoic acid 2-mercaptoethyl ester, 1,8-dimercapto-3,6-dioxaoctane, decanetrithiol, and dodecylmercaptan. Each of these hydrophobic chain transfer agents can be used alone or used in combination with others.

The addition amount of the chain transfer agent is determined such that the resulting copolymer has a desired molecular weight, and is preferably from 0.01 to 30 parts by weight, more preferably from 0.1 to 25 parts by weight, based on total weight of the monomers. When the addition amount is less than 0.01 parts by weight, the resulting copolymer will have too large a molecular weight, causing deterioration in fixability and gelation during the polymerization reaction. When the addition amount exceeds 30 parts by weight, the chain transfer agent will remain unreacted and the resulting copolymer will have too small a molecular weight, causing contamination of members.

The vinyl resin preferably has a weight average molecular weight (Mw) of from 3,000 to 300,000, more preferably from 4,000 to 100,000, and most preferably from 10,000 to 50,000. When the weight average molecular weight is less than 3,000, the vinyl resin has low mechanical strength and is brittle. Depending on usage conditions, the surface of the resulting toner may easily alter to cause drastic variation in chargeability, contamination of peripheral members, and quality issue accompanied thereby. When the weight average molecular weight exceeds 300,000, the number of molecular terminals is reduced and the degree of entanglement between core particles and molecular chains is reduced, resulting in deterioration of adhesiveness to core particles.

The vinyl resin preferably has a glass transition temperature (Tg) of 40° C. or more, more preferably 50° C. or more, and most preferably 60° C. or more. When Tg is less than 40° C., the resulting toner may cause blocking during storage at high temperatures, i.e., storage stability may deteriorate.

Colorant

Specific examples of usable colorants include dyes and pigments, such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination. The content of the colorant in the toner is typically from 1 to 15% by weight and preferably from 3 to 10% by weight.

Release Agent

Specific examples of usable release agents include, but are not limited to, polyolefin waxes (e.g., polyethylene wax, polypropylene wax), long-chain hydrocarbons (e.g., paraffin wax, Fischer-Tropsch wax, SASOL wax), and carbonyl-group-containing waxes. Specific examples of the carbonyl-group-containing waxes include, but are not limited to, polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanol esters (e.g., tristearyl trimellitate, distearyl maleatc), polyalkanoic acid amides (e.g., ethylenediamine dibehenylamide), polyalkyl amides (e.g., trimellitic acid tristearylamide), and dialkyl ketones (e.g., distearyl ketone). Among these waxes, polyolefin waxes and long-chain hydrocarbons, such as paraffin wax and Fischer-Tropsch wax, are preferable because they have small polarity and low melt viscosity.

External Additive

Fine Inorganic Particles

As an external additive for supplementing flowability, developability, and chargeability of the mother particles, fine inorganic particles are preferably used. The primary particle diameter of the fine inorganic particles is preferably from 5 nm to 2 μm, more preferably from 5 to 500 nm. The BET specific surface area of the fine inorganic particles is preferably from 2 to 500 $m^2/g$. The usage amount of the fine inorganic particles is preferably from 0.01 to 5% by weight, more preferably from 0.01 to 2.0% by weight, based on total weight of the toner. Specific examples of the fine inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Fine Polymeric Particles

Fine polymeric particles can also be used as the external additive. Specific examples of the fine polymeric particles include, but are not limited to, polymerized particles of: polystyrene or copolymers of methacrylates or acrylates, obtainable by soap-free emulsion polymerization, suspension polymerization, or dispersion polymerization; polycondensation polymers (e.g., silicone, bcnzoguanamine, nylon); and thermosetting resins.

Surface Treatment of External Additive

The external additive, for supplementing flowability of the toner, may be surface-treated to improve its hydrophobicity to prevent deterioration in flowability and chargeability even under high-humidity conditions. Specific examples of usable surface treatment agents include, but are not limited to, silane coupling agents, silylation agents, silane coupling agents having a fluorinated alkyl group, organic titanate coupling agents, aluminum coupling agents, silicone oils, and modified silicone oils. In a case in which the release agent contaminates the surface of the photoconductor to cause abnormal image or filming, silicone-oil-containing fine inorganic particles, such as silica, are preferably used as the surface-treated external additive. Such a surface-treated external additive gives good cleanability to the toner.

Silicone-oil-containing fine inorganic particles have high hydrophobicity and are capable of improving environmental charging stability and environmental resistance of the toner.

The average primary particle diameter of the silicone-oil-containing fine inorganic particles is preferably from 30 to 100 nm, more preferably from 30 to 80 nm. When the average primary particle diameter is less than 30 nm, the fine inorganic particles are likely to present on the toner-particle side and the silicone oil is not sufficiently supplied for cleaning, causing abnormal image. When the average primary particle diameter exceeds 100 nm, the fine inorganic particles easily release from the toner particles to contaminate developing members.

The amount of carbon derived from the silicone oil is preferably from 5.0 to 10.0% by weight, more preferably from 5.0 to 8.0% by weight, based on total weight of the fine inorganic particles. When the amount of carbon is less than 5.0% by weight, the silicone oil is not sufficiently supplied for cleaning, causing abnormal image and affecting environmental resistance. When the amount of carbon exceeds 10% by weight, free silicone oil may contaminate developing members.

Cleanability Improving Agent

As a cleanability improving agent for improving removability from photoconductor or primary transfer medium when remaining thereon after image transfer, for example, metal salts of fatty acids (e.g., zinc stearate, calcium stearate) and fine polymer particles prepared by soap-free emulsion polymerization (e.g., polymethyl methacrylate fine particles, polystyrene fine particles) can be used. Fine polymer particles having a relatively narrow particle size distribution and a volume average particle diameter of from 0.01 to 1 μm are preferred.

Method of Producing Toner

A method of producing the toner is described below for the purpose of illustration and not limitation.

Process of Preparing Mother Toner Particles (or Core Particles in the Case of Core-Shell Toner)

Organic Solvent

Volatile organic solvents having a boiling point less than 100° C. are preferably used in the process of preparing mother toner particles because they are easily removable after formation of mother toner particles. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. Among these solvents, ester solvents such as methyl acetate and ethyl acetate; aromatic solvents such as toluene and xylene; halogenated hydrocarbons such as methylene chloride, 1,2-dichloroethane, chloroform, and carbon tetrachloride are preferable. The polyester resin and colorant can be dissolved or dispersed in the organic solvent at the same time. Alternatively, they can be independently dissolved or dispersed in separate organic solvents or in a single organic solvent. The latter, i.e., using a single organic solvent is preferable in terms of the ease of solvent removal. When a single solvent or a mixed solvent which dissolves the polyester resin is used, the release agent will not be dissolved therein owing to the difference in solubility between the polyester resin and the release agent.

Dissolution or Dispersion of Polyester Resin

The solution or dispersion liquid of the polyester resin preferably has a resin concentration of from 40 to 80% by weight. When the resin concentration is too high, the solution or dispersion liquid becomes difficult to be dissolved or dispersed and becomes too viscous to easily handle. When the resin concentration is too low, the production amount of particles becomes small but the amount of solvent to be removed becomes large. When the modified polyester resin having terminal isocyanate group is used in combination with the polyester resin, they can be mixed in either a single solution or dispersion liquid or separate solutions or dispersion liquids. The latter, i.e., preparing separate solutions or dispersion liquids is preferable in view of their difference in solubility and viscosity.

Aqueous Medium

The aqueous medium may consist of water alone or a combination of water with a water-miscible solvent. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone). The usage amount of the aqueous medium is typically from 50 to 2,000 parts by weight, preferably from 100 to 1,000 parts by weight, based on 100 parts by weight of the fine resin particles.

Inorganic Dispersant and Fine Organic Resin Particle

When an inorganic dispersant or fine organic resin particle is previously dispersed in the aqueous medium before the solution or dispersion of the polyester resin, colorant, and release agent is dispersed therein, the resulting particles will have a narrow particle size distribution with high stability. Specific examples of the inorganic dispersant include, but are not limited to, tricalcium phosphate, calcium carbonate, titanium oxide, colloidal silica, and hydroxyapatite. Resins capable of forming their aqueous dispersion can be used for the fine organic resin particles. Specific examples of such resins include, but are not limited to, thermoplastic resins and thermosetting resins, such as vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. Among these resins, vinyl resin, polyurethane resin, epoxy resin, polyester resin, and combinations thereof are preferable because aqueous dispersions of fine spherical particles thereof are easily obtainable.

pH Adjuster

When the solution or dispersion of the polyester resin, colorant, and release agent is dispersed in the aqueous medium, inorganic bases or inorganic acids can be added therein for the purpose of adjusting the pH of the aqueous medium. The inorganic bases and inorganic acids are not limited to specific materials. In particular, when the fine particles in use are composed of a polyester resin or a resin having a high acid value, inorganic bases, such as sodium hydroxide, are preferably used.

Surfactant

When preparing the fine resin particles, surfactants can be used, if necessary. Specific examples of the surfactant include, but are not limited to, anionic surfactants such as alkylbenzene sulfonate, α-olefin sulfonate, and phosphates; cationic surfactants such as amine salt surfactants (e.g., alkylamine salts, amino alcohol fatty acid derivatives, polyamine fatty acid derivatives, imidazoline) and quaternary ammonium salt surfactants (e.g., alkyl trimethyl ammonium salts, dialkyl dimethyl ammonium salts, alkyl dimethyl benzyl ammonium salts, pyridinium salts, alkyl isoquinolinium salts, benzethonium chloride); nonionic surfactants such as fatty acid amide derivatives and polyol derivatives; and ampholytic surfactants such as alanine, dodecyldi (aminoethyl) glycine, di(octylaminoethyl) glycine, and N-alkyl-N,N-dimethyl ammonium betaine.

Surfactants having a fluoroalkyl group can achieve their effect in small amounts. Specific preferred examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C 10)-N-ethyl sulfonyl glycine salts, and monoperfluoroalkyl(C6-C16) ethyl phosphates. Specific examples of usable cationic surfactants include, but are not limited to, aliphatic primary, secondary, and tertiary amine acids having a fluoroalkyl group; aliphatic quaternary ammonium salts such as perfluoroalkyl(C6-C10) sulfonamide propyl trimethyl ammonium salts; benzalkonium salts; benzethonium chloride; pyridinium salts; and imidazolinium salts.

Polymeric Protection Colloids

Additionally, polymeric protection colloids are also usable to stabilize dispersing liquid droplets. Specific examples of usable polymeric protection colloids include, but are not limited to, homopolymers and copolymers of monomers such as acids (e.g., acrylic acid, methacrylic acid, α-cyanoacrylic acid, α-cyanomethacrylic acid, itaconic acid, crotonic acid, fumaric acid, maleic acid, maleic anhydride); acrylic and methacrylic monomers having hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide); vinyl alcohols; vinyl alcohol ethers (e.g., vinyl methyl ether, vinyl ethyl ether, vinyl propyl ether); esters of vinyl alcohols with compounds having carboxyl group (e.g., vinyl acetate, vinyl propionate, vinyl butyrate); acrylamide, methacrylamide, diacetone acrylamide, and methylol compounds thereof; acid chlorides (e.g., acrylic acid chloride, methacrylic acid chloride); and nitrogen-containing compounds or nitrogen-containing heterocyclic compounds (e.g., vinylpyridine, vinylpyrrolidone, vinylimidazole, ethyleneimine). Additionally, polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester) and celluloses (e.g., methyl cellulose, hydroxyethyl cellulose, hydroxypropyl cellulose) are also usable. In a case in which an acid-soluble or base-soluble substance, such as calcium phosphate, is used as a dispersion stabilizer, the resulting particles may be first washed with an acid (e.g., hydrochloric acid) to dissolve the dispersion stabilizer and then water to wash it away. Alternatively, such a dispersion stabilizer can be removed by being decomposed by an enzyme. The dispersant may remain on the surface of the toner particle. Preferably, in terms of chargeability, the dispersant is washed away from the surface of the toner particle.

Dispersing Method

Specific dispersing methods include, but are not limited to, methods using an equipment of any of the following types: low-speed shearing type, high-speed shearing type, frictional type, high-pressure jet type, and ultrasonic type. When a high-speed shearing type disperser is used, the revolution is typically from 1,000 to 30,000 rpm and preferably from 5,000 to 20,000 rpm. The dispersing temperature is typically from 0 to 150° C. (under pressure) and preferably from 20 to 80° C.

Process of Preparing Oily Phase

An oily phase, in which the resin, colorant, release agent, etc. are dissolved or dispersed in the organic solvent, can be prepared by gradually adding the resin, colorant, release agent, etc. in the organic solvent while stirring the organic solvent. When a pigment is used as the colorant and/or a charge controlling agent which is poorly soluble in the organic solvent is used, it is preferable that such materials be previously ground into fine particles before being added to the organic solvent.

When the release agent is added by means of the release-agent-containing resin, the resin only has to be dissolved in the organic solvent that dissolves the resin. In most cases, the release agent dissolves little in the organic solvent because it is incompatible with the resin that is soluble in the organic solvent. Therefore, the release agent can keep the same particle diameter and shape as it is contained in the resin.

Colorants and charge controlling agents may be previously combined with a resin to be formed into a master batch.

Alternatively, colorants and charge controlling agents, optionally along with a dispersing auxiliary agent, may be previously combined with a resin in a wet condition (i.e., in an organic solvent) to be formed into a wet master batch.

When such materials are meltable at temperatures below the boiling point of the organic solvent, they can be previously crystallized. In other words, they can be formed into fine crystal grain by being dissolved in the organic solvent, optionally along with a dispersing auxiliary agent, while stirring and heating the organic solvent and subsequently being cooled while stirring or shearing the organic solvent.

After being dispersed in the organic solvent along with the resin by the above procedures, the colorants and charge controlling agents may be further subjected to a dispersion treatment using a disperser, such as a bead mill and a disc mill.

Process of Preparing Core Particles

A dispersion liquid in which core particles composed of the oily phase are dispersed in the aqueous medium can be prepared by dispersing the above-prepared oily phase in the aqueous medium using an equipment of any of the following types: low-speed shearing type, high-speed shearing type, frictional type, high-pressure jet type, and ultrasonic type. To adjust the particle diameter of the dispersing elements to 2 to 20 μm, a high-speed shearing type disperser is preferable. When a high-speed shearing type disperser is used, the revolution is set to typically from 1,000 to 30,000 rpm and preferably from 5,000 to 20,000 rpm. The dispersing time for a batch type disperser is typically from 0.1 to 5 minutes, but is not limited thereto. When the dispersing time exceeds 5 minutes, undesired small-diameter particles may remain or the dispersion may become excessively dispersed or unstable to generate aggregations and coarse particles. The dispersing temperature is typically from 0 to 40° C. and preferably from 10 to 30° C. When the dispersing temperature exceeds 40° C., molecular motion becomes active to reduce dispersion stability and to generate aggregations and coarse particles. When the dispersing temperature falls below 0° C., the dispersing elements increase in viscosity to increase the shearing force needed for dispersing them, resulting in decrease in manufacturing efficiency.

The above-described examples of surfactants to be used for preparing the fine resin particles can also be used for this process. In order to efficiently disperse oil droplets containing solvents, disulfonic acid salts having a high HLB are preferably used. The content of the surfactant in the aqueous medium is from 1 to 10% by weight, preferably from 2 to 8% by weight, and more preferably from 3 to 7% by weight. When the content exceeds 10% by weight, the oil droplets may become too small or form a reverse micelle structure to reduce dispersion stability and to coarsen the oil droplets. When the content falls below 1% by weight, it is difficult to stably disperse the oil droplets and the oil droplets get coarsened.

Process of Adhering (Half-Embedding) Fine Resin Particles

In the resulting core particle dispersion liquid, liquid droplets of the core particles can be stably dispersed while the core particle dispersion liquid is being stirred. By pouring the dispersion liquid of fine vinyl resin particles in the core particle dispersion liquid being stirred, the fine vinyl resin particles are adhered to (or half-embedded in) the surfaces of the core particles. It is preferable that the amount of time it takes to pour the dispersion liquid of fine vinyl resin particles in the core particle dispersion liquid is 30 seconds or more. When the amount of time is less than 30 seconds, the dispersion system is rapidly changed to generate aggregated particles or the adherence of the fine vinyl resin particles becomes non-uniform. Taking too large an amount of time, for example, 60 minutes or more, is not preferable in terms of production efficiency.

The dispersion liquid of fine vinyl resin particles may be diluted or condensed to adjust the concentration before being poured in the core particle dispersion liquid. The dispersion liquid of fine vinyl resin particles preferably has a concentration of from 5 to 30% by weight, more preferably from 8 to 20% by weight. When the concentration falls below 5% by weight, pouring of the dispersion liquid causes a large change in organic solvent concentration, resulting in insufficient adherence of the fine resin particles ton the core particles. When the concentration exceeds 30% by weight, it is likely that the fine vinyl resin particles are non-uniformly distributed in the core particle dispersion liquid, resulting in non-uniform adherence of the fine vinyl resin particles to the core particles.

Solvent Removal

The organic solvent is removed from the resulting mother particle dispersion liquid by, for example, gradually heating the whole system under normal or reduced pressures to completely evaporate the organic solvent from the liquid droplets.

Elongation and/or Cross-linking Reaction

When the modified polyester resin having terminal isocyanate group is added for the purpose of introducing the polyester resin having urethane and/or urea bonds, a reaction with a separately-added amine occurs, or a part of the isocyanate groups react with water etc. to produce amino groups and the amino groups further react with other isocyanate groups. In the case of separately adding an amine, the amine can be mixed in the oily phase before the toner composition is dispersed in the aqueous medium, or in the aqueous medium directly. The time required for the reaction depends on the structure of isocyanate group contained in the polyester prepolymer and the reactivity of the amine, and is typically from 1 minute to 40 hours and preferably from 1 to 24 hours. The reaction temperature is typically from 0 to 150° C. and preferably from 40 to 98° C.

Process of Washing and Drying

The mother toner particles dispersed in the aqueous medium can be washed and dried by any known method.

For example, the mother toner powder can be obtained by the following processes. First, the dispersion liquid is subjected to solid-liquid separation by means of a centrifugal separator or filter press. The resulting toner cake is redispersed in ion-exchange water having a temperature ranging from normal temperature to about 40° C. After optionally adjusting the pH by means of acids and bases, the redispersion liquid is subjected to solid-liquid separation again. This procedure is repeated several times until impurities and surfactants are removed. The toner cake is then dried by a flash dryer, a circulating dryer, a reduced-pressure dryer, or a vibrating fluid bed dryer. After being dried, the mother toner particles may be optionally subjected to classification using a classifier to have a desired particle diameter distribution.

External Treatment

The mother toner particles thus obtained are mixed with heterogeneous particles of external additives, such as charge controlling particles or fluidizing particles, to obtain a toner. The mixed powder can be given a mechanical impulsive force so that the heterogeneous particles are fixed or fused on the surfaces of the mother particles and are prevented from releasing therefrom. Methods of imparting mechanical impulsive force include, for example, agitating the mixed powder with blades rotating at a high speed, and accelerating the mixed powder in a high-speed airflow to allow the particles collide with each other or to allow the combined particles collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

Image forming Apparatus

The image forming apparatus according to an embodiment of the present invention uses the toner according to an embodiment of the present invention. The toner according to an embodiment of the present invention can be used for either one-component developer or two-component developer, but is preferably used for one-component developer. The image forming apparatus according to an embodiment of the present invention preferably includes an endless-type intermediate transfer device. Further, the image forming apparatus according to an embodiment of the present invention preferably includes a photoconductor and a cleaner to remove residual toner remaining on the photoconductor and/or the intermediate transfer device. The cleaner may or may not include a cleaning blade. The image forming apparatus according to an embodiment of the present invention preferably includes a fixing device which has a roller or belt equipped with a heater. Further, the image forming apparatus according to an embodiment of the present invention preferably includes a fixing device having a fixing member which does not need application of oil. The image forming apparatus according to an embodiment of the present invention preferably includes other devices, such as neutralizer, recycler, and controller, as necessary.

The image forming apparatus according to an embodiment of the present invention may include a process cartridge containing a latent image bearer, a developing device, and a cleaner, which is detachably mountable on the image forming apparatus. Alternatively, a single unit of process cartridge containing a photoconductor and at least one member selected from a charger, an irradiator, a developing device, a transfer device, a separator, and a cleaner, can be detachably mounted on the image forming apparatus having a guide member, such as rails, for guiding the process cartridge.

Figure 3:
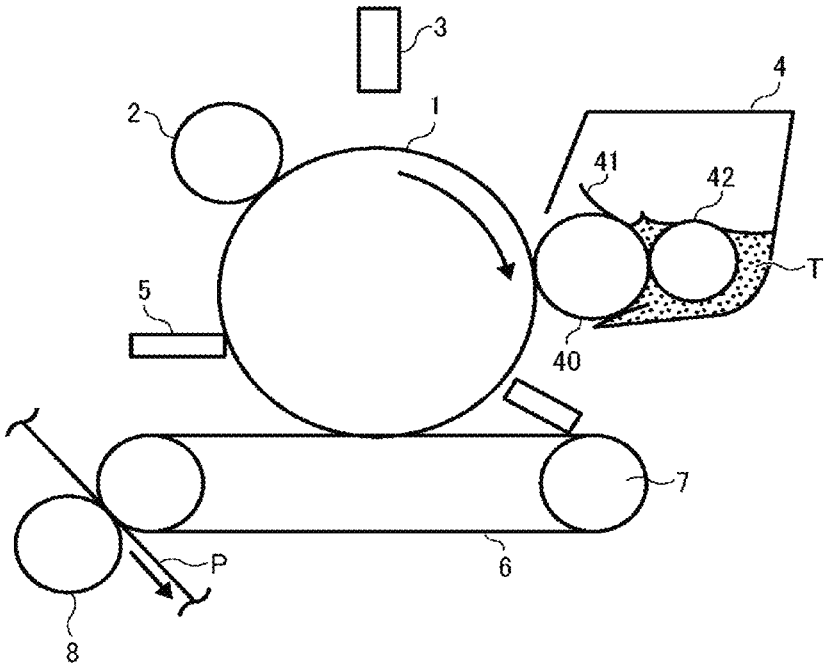
FIG. 3 is a schematic view of an image forming apparatus according to an embodiment of the present invention.

FIG. 3 is a schematic view of an image forming apparatus according to an embodiment of the present invention. The image forming apparatus has a body casing containing a latent image bearer 1 driven to rotate clockwise in FIG. 3; and a charger 2, an irradiator 3, a developing device 4 containing the toner T according to an embodiment of the present invention, a cleaner 5, an intermediate transfer member 6, a support roller 7, a transfer roller 8, and a neutralizer, each disposed around the latent image bearer 1.

The image forming apparatus has a paper feeding cassette for storing sheets of recording paper P serving as recording medium. Each sheet of recording paper P stored in the paper feeding cassette is fed to between the transfer roller 8 and the intermediate transfer member 6 at a right timing controlled by a pair of registration rollers.

The latent image bearer 1 is driven to rotate clockwise in FIG. 3 and uniformly charged by the charger 2. The latent image bearer 1 is then irradiated with laser light modulated by image data and emitted from the irradiator 3 to form an electrostatic latent image thereon. The developing device 4 supplies toner to the latent image bearer 1 to develop the electrostatic latent image into a toner image. A transfer bias is applied from the latent image bearer 1 to the intermediate transfer member 6 to transfer the toner image onto the intermediate transfer member 6. A sheet of recording paper P is fed to between the intermediate transfer member 6 and the transfer roller 8 so that the toner image can be transferred onto the recording paper P. The sheet of recording paper P having the transferred toner image thereon is fed to a fixing device.

The fixing device includes a fixing roller heatable by a built-in heater to a predetermined fixing temperature and a pressing roller pressed against the fixing roller at a predetermined pressure. The fixing device heats and pressurizes the sheet of recording paper P fed from the transfer roller 8 to fix the toner image on the sheet and ejects it on the paper ejection tray.

On the other hand, the latent image bearer 1, from which the toner image has been transferred onto the recording paper P by the transfer roller 8, is further rotated so that residual toner particles remaining on the surface of the latent image bearer 1 are removed by the cleaner 5. The latent image bearer 1 is then neutralized by the neutralizer. After the neutralized latent image bearer 1 is uniformly charged by the charger 2, the image forming apparatus performs a next image forming operation in the same manner as described above.

The latent image bearer 1 is not limited in material, shape, structure, and size. The preferred shape is a drum-like or belt-like shape. Specific examples of usable materials include, but are not limited to, inorganic photoconductors such as amorphous silicon and selenium and organic photoconductors such as polysilane and phthalopolymethine. Among these materials, amorphous silicon and organic photoconductor are preferable in terms of long operating life.

An electrostatic latent image can be formed by, for example, uniformly charging a surface of the latent image bearer 1 and irradiating the surface with light containing image information by an electrostatic latent image forming device. The electrostatic latent image forming device may include at least the charger 2 for charging a surface of the latent image bearer 1 and the irradiator 3 for irradiating the surface of the latent image bearer 1 with light containing image information.

The charging process can be performed by applying a voltage to a surface of the latent image bearer 1 by the charger 2.

Specific examples of the charger 2 include, but are not limited to, contact chargers equipped with a conductive or semiconductive roller, brush, film, or rubber blade and non-contact chargers employing corona discharge such as corotron and scorotron.

In addition, the charger 2 may be in the form of magnetic brush, fur brush, etc. The shape of the charger 2 can be determined according to the specification and configuration of the image forming apparatus. When the charger 2 employs magnetic brush, the charger 2 may be composed of a magnetic brush comprised of ferrite particles, such as Zn—Cu ferrite, serving as charging members; a non-magnetic conductive sleeve for supporting the ferrite particles; and a magnet roll contained in the sleeve. When the charger 2 employs fur brush, the charger 2 may be composed of a fur treated with carbon, copper sulfide, metal, or metal oxide to have conductivity; and a metal or a cored metal treated to have conductivity, around which the fur wound or to which the fur attached.

The charger 2 is not limited to a contact charger, but preferably be a contact charger because the image forming apparatus can be reduced in amount of generating ozone.

The irradiating process can be performed by irradiating the charged surface of the latent image bearer 1 with light containing image information by the irradiator 3. The irradiator 3 is not limited in configuration so long as the surface of the latent image bearer 1 charged by the charger 2 can be irradiated with light containing image information. Specific examples of the irradiator 3 include, but are not limited to, various irradiators of radiation optical system type, rod lens array type, laser optical type, and liquid crystal shutter optical type.

The developing process can be performed by developing an electrostatic latent image with the toner according to an embodiment of the present invention by the developing device 4. The developing device 4 is not limited in configuration so long as the toner according to an embodiment of the present invention can be used for the development. For example, a developing device capable of storing the toner according to an embodiment of the present invention and supplying the toner to the electrostatic latent image either by contact therewith or without contact therewith is preferable.

The developing device 4 preferably includes a developing roller 40 and a thin layer forming member 41. The developing roller 40 bears toner on its peripheral surface and rotates in contact with the latent image bearer 1 to supply the toner to an electrostatic latent image formed on the latent image bearer 1. The thin layer forming member 41 is in contact with the peripheral surface of the developing roller 40 to form the toner on the developing roller 40 into a thin layer.

A metallic roller or an elastic roller is preferably used for the developing roller 40. Specific examples of metallic roller include, but are not limited to, aluminum roller. It is relatively easy to form a metallic roller into the developing roller 40 having an arbitrary surface friction coefficient by means of blast treatment. For example, an aluminum roller can be blast-treated with glass beads to have a rough surface. The resulting developing roller can carry a proper amount of toner thereon.

Usable elastic roller includes a roller covered with an elastic rubber layer having a surface coat layer composed of a material easily chargeable to the opposite polarity to the toner. The JIS-A hardness of the elastic rubber layer is set to 60 degrees or below so as to prevent toner deterioration which may be caused due to pressure concentration at the abutment part of the elastic rubber layer against the thin layer forming member 41. The surface roughness (Ra) is set to from 0.3 to 2.0 μm so that a necessary amount of toner can be carried on the surface. The resistance value of the elastic rubber layer is set to from $10^3$ to $10^{10}\Omega$ so that a developing bias can be applied to the developing roller 40 to form an electric field between the developing roller 40 and the latent image bearer 1. The developing roller 40 rotates clockwise so as to convey toner carried on its surface to the position where it faces the thin layer forming member 41 and the position where it faces the latent image bearer 1.

The thin layer forming member 41 is disposed on a downstream position from the abutment position of the developing roller 40 against a supply roller 42. The thin layer forming member 41 is a metallic platy spring composed of stainless steel (SUS), phosphor bronze, etc. The free end thereof is pressed against the surface of the developing roller 40 at a pressure of from 10 to 40 N/m. Toner particles having passed under the pressing point are formed into a thin layer and given charge by frictional charging. To assist the frictional charging, a regulation bias having a value offset from the developing bias in the same direction as the charging polarity of the toner is applied to the thin layer forming member 41.

Specific examples of rubber elastic bodies composing the surface of the developing roller 40 include, but are not limited to, styrene-butadiene copolymer rubber, acrylonitrile-butadiene copolymer rubber, acrylic rubber, epichlorohydrin rubber, urethane rubber, silicone rubber, and blends of these materials. Among these materials, blended rubber of epichlorohydrin rubber with acrylonitrile-butadiene copolymer rubber is preferable.

The developing roller 40 can be produced by, for example, covering the outer periphery of a conductive shaft with the rubber elastic body. The conductive shaft can be comprised of metals such as stainless steel (SUS).

The transfer process can be performed by charging the latent image bearer 1 by a transfer device. The transfer device preferably includes a primary transfer device to transfer a toner image onto the intermediate transfer member 6 to form a transfer image and a secondary transfer device (e.g., the transfer roller 8) to transfer the transfer image onto a sheet of recording paper P. Preferably, at least two toners with different colors, more preferably multiple toners for full-color printing, are used in the transfer process, and the transfer process includes a primary transfer process in which multiple toner images with different colors are transferred onto the intermediate transfer member 6 to form a composite transfer image and a secondary transfer process in which the composite transfer image is transferred onto a sheet of recording paper P.

Specific examples of the intermediate transfer member 6 include, but are not limited to, transfer belt.

Each transfer device (i.e., primary transfer device, secondary transfer device) preferably includes a transferer to separate a toner image formed on the latent image bearer 1 to the recording paper P side by charging. The number of the transfer devices may be one, or two or more. Specific examples of the transfer device include, but are not limited to, corona transferer, transfer belt, transfer roller, pressure transfer roller, and adhesive transferer.

The recording paper P is not limited in material so long as an unfixed developed image can be transferred thereon. Specific examples of the recording paper P include, but are not limited to, normal paper and PET base for OHP.

The fixing process can be performed by fixing a toner image transferred onto a sheet of recording paper P thereon by the fixing device. The fixing process may be performed either every time each color toner image is transferred onto the sheet or at once after all color toner images are superimposed on one another.

The fixing device is not limited in configuration but preferably includes a heat-pressure member. Specific examples of the heat-pressure member include, but are not limited to, a combination of a heat roller and a pressure roller; and a combination of a heat roller, a pressure roller, and an endless belt. The heating temperature of the heat-pressure member is preferably from 80 to 200° C.

Figure 4:
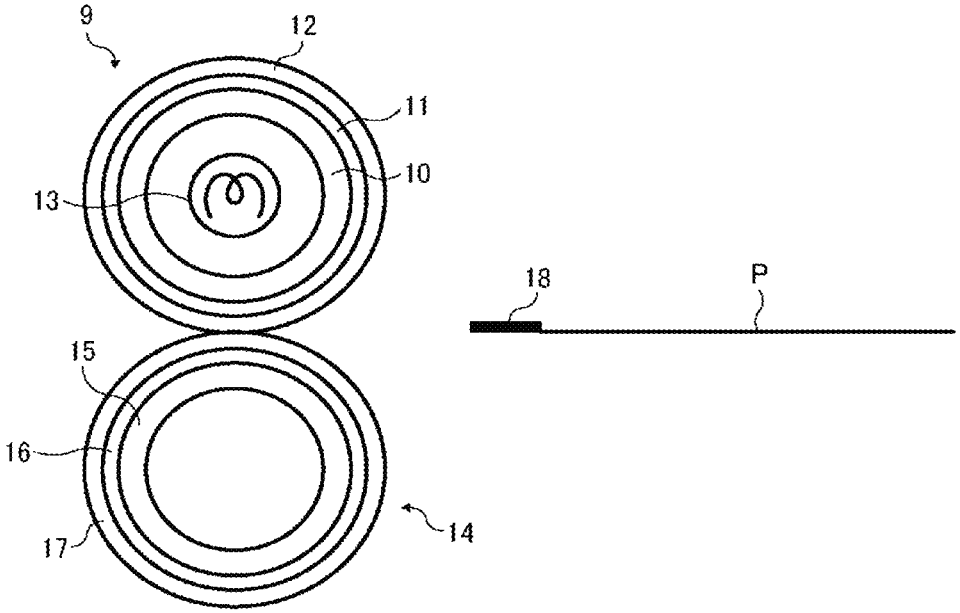
FIG. 4 is a schematic view of a fixing device including a soft roller having a fluorine-based surface layer.

The fixing device may have a configuration as illustrated in FIG. 4 which includes a soft roller having a fluorine-based surface layer. A heat roller 9 includes an aluminum cored bar 10, an elastic body layer 11 composed of a silicone rubber, a surface layer 12 composed of PFA (i.e., tetrafluoroethylene-perfluoroalkylvinyl ether copolymer), and a heater 13 contained in the aluminum cored bar 10. A pressure roller 14 includes an aluminum cored bar 15, an elastic body layer 16 composed of a silicone rubber, and a surface layer 17 composed of PFA. A sheet of recording paper P having an unfixed toner image 18 thereon is allowed to pass as illustrated in FIG. 4.

The fixing device may be used together with or replaced with an optical fixer, in accordance with intended use.

The neutralization process can be performed by applying a neutralization bias to the latent image bearer 1 by a neutralizer. The neutralizer is not limited in configuration so long as a neutralization bias can be applied to the latent image bearer 1. Specific examples of the neutralizer include, but are not limited to, neutralization lamp.

The cleaning process can be performed by removing residual toner particles remaining on the latent image bearer 1 by the cleaner 5. The cleaner 5 is not limited in configuration so long as residual toner particles remaining on the latent image bearer 1 can be removed. Specific examples of the cleaner 5 include, but are not limited to, magnetic brush cleaner, electrostatic brush cleaner, magnetic roller cleaner, blade cleaner, brush cleaner, and web cleaner.

The recycle process can be performed by conveying the toner particles removed by the cleaner 5 to the developing device 4 by a recycler. The recycler is not limited in configuration. Specific examples of the recycler include, but are not limited to, conveyor. The control process can be performed by controlling the above-described processes by a controller. The controller is not limited in configuration so long as the above-described processes can be controlled. Specific examples of the controller include, but are not limited to, sequencer and computer.

The image forming apparatus and process cartridge according to some embodiments of the present invention provide good-quality image when used in combination with a toner having excellent fixability and being less likely to deteriorate (fracture) even when stressed in the developing process.

Multicolor Image Forming Apparatus

Figure 5:
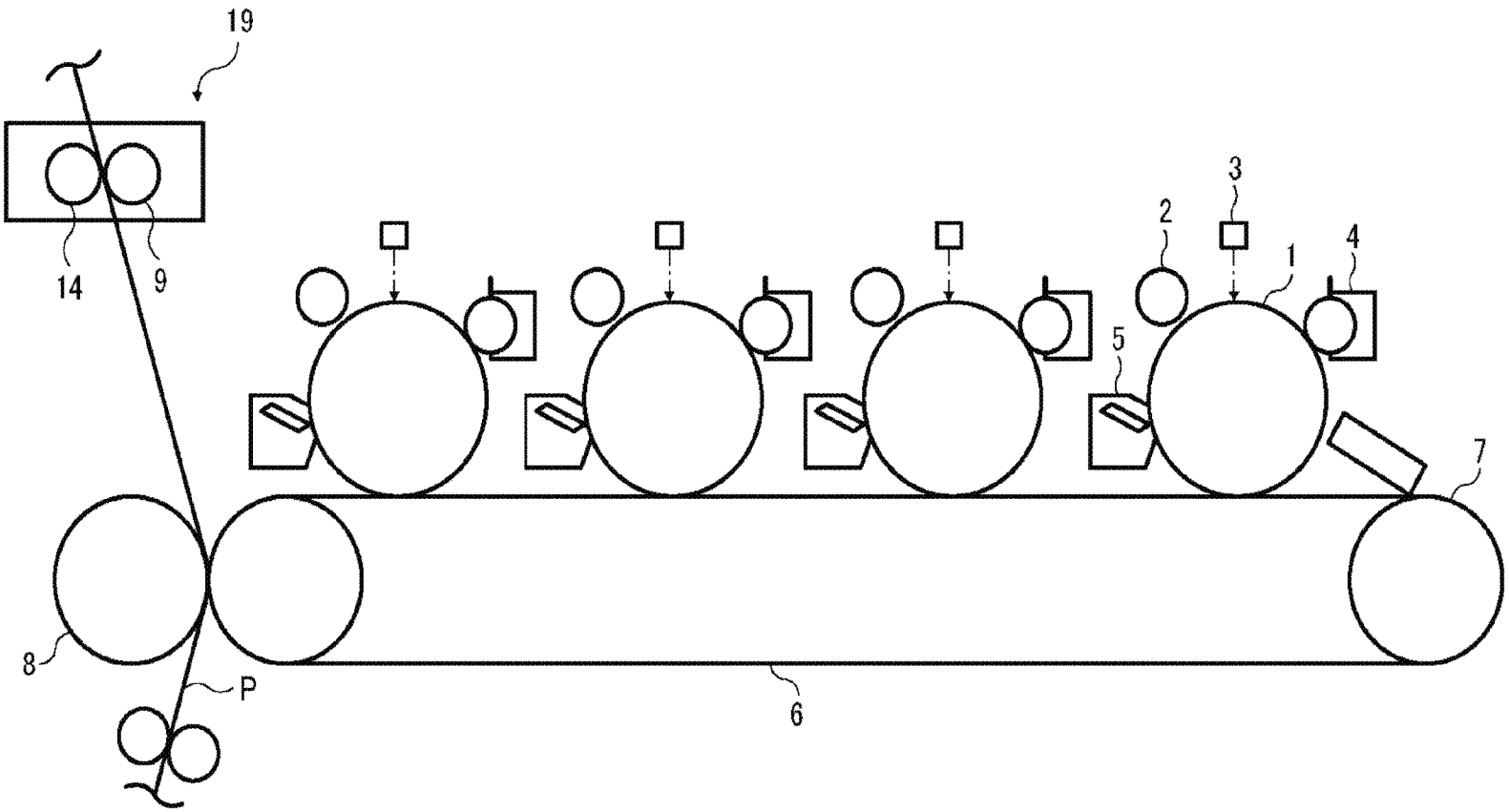
FIG. 5 is a schematic view of a multicolor image forming apparatus according to an embodiment of the present invention.

FIG. 5 is a schematic view of a multicolor image forming apparatus according to an embodiment of the present invention. The apparatus illustrated in FIG. 5 is a tandem-type full-color image forming apparatus.

The image forming apparatus illustrated in FIG. 5 has a body casing containing: multiple latent image bearers 1 driven to rotate clockwise in FIG. 5; chargers 2, irradiators 3, developing devices 4, cleaners 5, each disposed around the latent image bearers 1; and an intermediate transfer member 6, a support roller 7, and a transfer roller 8. The image forming apparatus has a paper feeding cassette for storing sheets of recording paper P. Each sheet of recording paper P stored in the paper feeding cassette is fed to between the intermediate transfer member 6 and the transfer roller 8 at a right timing controlled by a pair of registration rollers and then fed to a fixing device 19.

The latent image bearer 1 is driven to rotate clockwise in FIG. 5 and uniformly charged by the charger 2. The latent image bearer 1 is then irradiated with laser light modulated by image data and emitted from the irradiator 3 to form an electrostatic latent image thereon. The developing device 4 supplies toner to the latent image bearer 1 to develop the electrostatic latent image into a toner image. The toner image formed by supplying toner to the latent image bearer 1 by the developing device 4 is then transferred onto the intermediate transfer member 6. This procedure is performed with respect to each color, i.e., cyan, magenta, yellow, and black, to form a full-color toner image.

Figure 6:
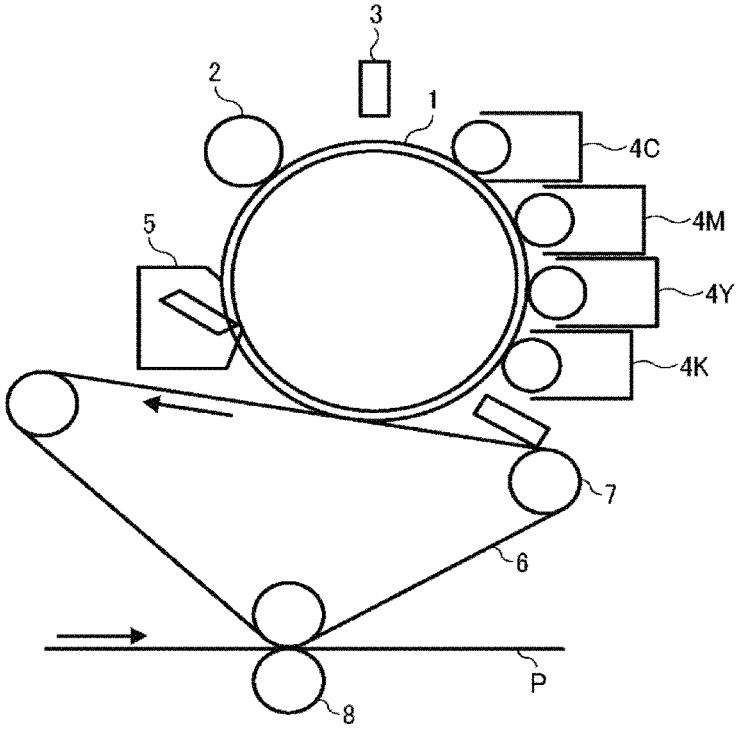
FIG. 6 is a schematic view of a revolver full-color image forming apparatus according to an embodiment of the present invention.

FIG. 6 is a schematic view of a revolver full-color image forming apparatus according to an embodiment of the present invention. By switching developing operation from one of developing devices 4C, 4M, 4Y, and 4K to another, multiple color toners are sequentially developed on a single latent image bearer 1 to form a full-color toner image. A transfer roller 8 transfers the full-color toner image from an intermediate transfer member 6 onto a sheet of recording paper P. The sheet having the transferred toner image thereon is fed to a fixing device.

On the other hand, the latent image bearer 1, from which the toner image has been transferred onto the recording paper P by the intermediate transfer member 6, is further rotated so that residual toner particles remaining on the surface of the latent image bearer 1 are removed by a blade of the cleaner 5. The latent image bearer 1 is then neutralized by a neutralizer. After the neutralized latent image bearer 1 is uniformly charged by the charger 2, the image forming apparatus performs a next image forming operation in the same manner as described above. The cleaner 5 is not limited to that employing a blade for scraping off residual toner particles from the latent image bearer 1 and may employ a fur brush for scraping off residual toner particles from the latent image bearer 1.

The image forming apparatus according to an embodiment of the present invention uses the toner according to an embodiment of the present invention and therefore provides good-quality image.

Process Cartridge

A process cartridge according to an embodiment of the present invention includes at least an electrostatic latent image bearer for bearing an electrostatic latent image and a developing device for developing the electrostatic latent image on the electrostatic latent image bearer into a visible image with the toner according to an embodiment of the present invention. The process cartridge may optionally include other devices, such as a charger, a transfer device, a cleaner, and a neutralizer, as needed. The process cartridge is detachably mountable on image forming apparatus.

The developing device includes at least a developer container for containing the toner or developer according to an embodiment of the present invention and a developer bearer for bearing and conveying the toner or developer contained in the developer container. The developing device may optionally include a layer thickness regulator for regulating the thickness of the toner on the developer bearer. The process cartridge according to an embodiment of the present invention is detachably mountable on any of electrophotographic apparatus, facsimile machine, or printer. Preferably, the process cartridge is detachable mounted on the image forming apparatus according to an embodiment of the present invention.

Figure 7:
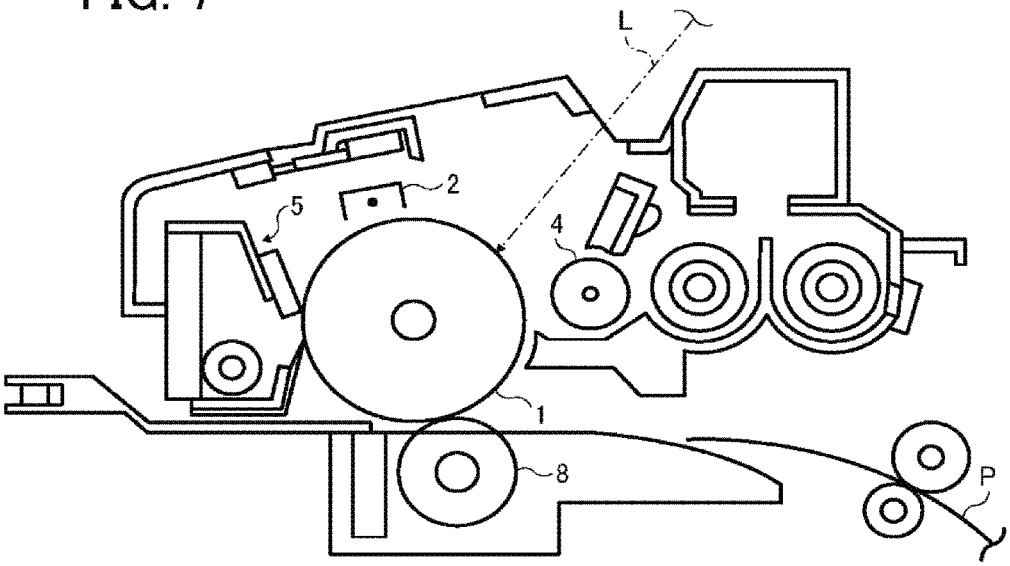
FIG. 7 is a schematic view of a process cartridge according to an embodiment of the present invention.

The process cartridge includes a latent image bearer 1, a charger 2, a developing device 4, a transfer roller 8, and a cleaner 5, as illustrated in FIG. 7. In FIG. 7, L denotes light emitted from an irradiator and P denotes a sheet of recording paper. The latent image bearer 1 has the same configuration as that used for the above-described image forming apparatus. The charger 2 can use any charging member.

The process cartridge illustrated in FIG. 7 forms image as follows. The latent image bearer 1 is charged by the charger 2 and then irradiated with light L emitted from an irradiator while rotating clockwise in FIG. 7 so that an electrostatic latent image is formed thereon. The electrostatic latent image is developed into a toner image by the developing device 4. The toner image is transferred onto a sheet of recording paper P by the transfer roller 8 and the sheet is then ejected. The surface of the latent image bearer 1 from which the toner image has been transferred is cleaned by the cleaner 5 and then neutralized by a neutralizer. These procedures are repeated.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

First, analysis and evaluation methods for the toners obtained in the following examples are described.

In the following examples, analysis and evaluation are made with respect to a case in which the toners are used for one-component developer. However, the toners according to some embodiments of the present invention can be used for two-component developer by having a proper external treatment and using along with proper carrier particles.

Measurement Methods

Average Particle Diameter

Particle size distribution of toner particles is measured by a particle size analyzer which employs the Coulter Counter method, such as COULTER COUNTER TA-II, COULTER MULTISIZER II, and COULTER MULTISIZER III (all available from Beckman Coulter Inc.), in the following manner.

First, 0.1 to 5 ml of a surfactant (preferably an alkylbenzene sulfonate), serving as a dispersant, is added to 100 to 150 ml of an electrolyte. Here, the electrolyte is an about 1% NaCl aqueous solution prepared with the first grade sodium chloride, such as ISOTON-II (available from Beckman Coulter, Inc.). Next, 2 to 20 mg of a sample (toner) is added thereto. The electrolyte in which the sample is suspended is subjected to a dispersion treatment using an ultrasonic disperser for about 1 to 3 minutes and then to the measurement of the volume and number of toner particles using the above-described instrument equipped with a 100-μm aperture to calculate volume and number distributions. The volume average particle diameter (Dv) and number average particle diameter (Dn) of the sample can be calculated from the volume and number distributions obtained above.

Average Circularity

The shapes of toner particles are determined by means of optical detection band, in particular, by passing a suspension liquid containing toner particles through a detecting band in an imaging area provided on a flat plate, optically detecting images of the toner particles with a CCD camera, and analyzing the images. The circularity of a toner particle is defined as a value obtained by dividing the peripheral length of a circle having the same area as a projected image of the toner particle by the peripheral length of the projected image. In the present disclosure, the average circularity is measured by a flow particle image analyzer FPIA-3000S. Specifically, 0.1 to 0.5 ml of a surfactant (preferably an alkylbenzene sulfonate), serving as a dispersant, is added to 100 to 150 ml of water from which solid impurities have been removed, and further 0.1 to 0.5 g of a sample is added thereto. The resulting suspension liquid in which the sample is suspended is subjected to a dispersion treatment using an ultrasonic disperser for about 1 to 3 minutes and then to the measurement of the shapes of toner particles and its distribution using the above-described instrument while adjusting the dispersion liquid concentration to from 3,000 to 10,000 particles/μl.

Volume Average Particle Diameter of Fine Resin Particles

The volume average particle diameter of fine resin particles is measured by a Nanotrac Wave Particle Analyzer UPA-EX150 employing dynamic light scattering method / laser Doppler method (from Nikkiso Co., Ltd.). Specifically, a dispersion liquid in which fine resin particles are dispersed is subjected to the measurement while the concentration thereof is adjusted to be within the measurement concentration range. The background is measured in advance with blank dispersion solvent. Fine resin particles according to an embodiment of the present invention, which have a volume average particle diameter of several tens nm to several μm, can be measured by the above procedure.

Molecular Weight

Molecular weights of resins, such as polyester resins and vinyl copolymer resins, are measured by GPC (gel permeation chromatography) under the following conditions.

Instrument: HLC-8220GPC (from Tosoh Corporation)

Columns: TSKgel SuperHZM-M×3

Temperature: 40° C.

Solvent: THF (Tetrahydrofuran)

Flow rate: 0.35 ml/min

Sample concentration: 0.05-0.6%, Injection amount: 0.01 ml

The weight average molecular weight (Mw) is determined from the resulting molecular weight distribution curve with reference to a calibration curve complied with monodisperse polystyrene standard samples. The monodisperse polystyrene standard samples include ten samples each having a molecular weight of 5.8×100, 1.085×10,000, 5.95×10,000, 3.2×100,000, 2.56×1,000,000, 2.93×1,000, 2.85×10,000, 1.48×100,000, 8.417×100,000, and 7.5×1,000,000.

Glass Transition Temperature and Endothermic Quantity

The glass transition temperature of a resin is measured by a differential scanning calorimeter (e.g., DSC-6220R from Seiko Instruments Inc.) as follows. First, a sample is heated from room temperature to 150° C. at a heating rate of 10° C./min to obtain a 1st scanned data. Next, the sample is allowed to stand for 10 minutes at 150° C., cooled to room temperature, allowed to stand for 10 minutes at room temperature, and reheated to 150° C. at a heating rate of 10° C./min, to obtain a 2nd scanned data. The glass transition temperature is determined from the intersection point of the baseline with the tangent line at a curved portion of the data that is indicating the occurrence of glass transition.

In some cases, there is a possibility that the 1st scanned data may be overlapped with a curve indicating the heat of melting of the release agent contained in the toner, and therefore the glass transition temperature determined from the 1st scanned data may be unclear. Thus, in the present disclosure, the glass transition temperature is determined from the 2nd scanned data.

The endothermic quantity and melting point of the release agent and crystalline resin can also be determined in the same manner as above. Endothermic quantity is determined by calculating the peak area of an endothermic peak. The release agent generally melts at a temperature lower than the fixing temperature of the toner. The melting heat of the release agent at the time of fixing of the toner appears as an endothermic peak. Some kinds of release agents generate heat of transition due to the occurrence of phase transfer in a solid phase. In such cases, in the present disclosure, total amount of the heats of melting and transition is regarded as the endothermic quantity of the heat of melting.

Softening Point of Toner

The softening point of toner is measured as follows. First, a toner is subjected to a humidity conditioning at a temperature of 24 degrees and a relative humidity of 50% RH for at least 24 hours. Next, 1.5 g of the toner is pelletized with a weight of 4 kN for 30 seconds using a pelletizer. The pellet is subjected to a measurement with a flow tester (CFT-500 from Shimadzu Corporation) using a die having a height of 1.0 mm and a diameter of 1.0 mm under the following conditions: the heating rate is 3.0 degrees/min, the preheating time is 180 seconds, the load is 30 kg, and the measuring temperature ranges from 80 to 140 degrees. The softening point is defined as a temperature at which ½ of the pellet sample has flown out. The flow starting temperature is denoted by Tfb.

Observation of Cross-section of Toner

A toner is embedded in a normal-temperature-curable epoxy resin and then the epoxy resin is cured into a block.

The block is cut into thin sections having a thickness of from 80 to 200 nm using a microtome equipped with a diamond knife to prepare a measurement sample.

The thin sections are observed with a scanning transmission electron microscope (STEM) and the observed images are photographed. The cross-sectional structure of the toner is visually observed from the photographs.

The resins contained in the toner become more distinguishable from one another in the case in which the measurement sample has been dyed with ruthenium tetraoxide. The dying time depends on conditions, but is normally several minutes. Each resin is different in dying speed due to the difference in chemical structure. If the resins have been subjected to the dying for too long a time, it may be difficult to distinguish the resins from one another. Therefore, the dying time should be adjusted to a relatively shorter time such that the resins can be distinguishable from one another. When a hydrocarbon wax is used as the release agent, the release agent can be clearly distinguishable from other resins without being dyed.

The photographed image data is incorporated into an image analyzer (Luzex III from Nireco Corporation) and 300 randomly-selected toner particles which satisfy the following formula (1) are analyzed to calculate the shape factor SF-1 and the longest cross-sectional diameters of each toner particle and the release agent contained therein to further calculate the rate of toner particles which satisfy the following formula (2). In the formulae (1) and (2), Dv represents a volume average particle diameter of the toner particles; and T and R represent the longest cross-sectional diameters of each toner particle and the release agent contained therein, respectively.

$$2/3 \leq T/Dv \leq 1.5 \quad (1)$$

$$1/3 \leq R/Dv \leq 1.0 \quad (2)$$

The shape factor SF-1 is calculated from the following equation.

$$SF\text{-}1=(Lmx)^2/Ar\times\pi/4\times100$$

wherein Lmx represents an absolute maximum length and Ar represents a projected image area.

Figure 2:
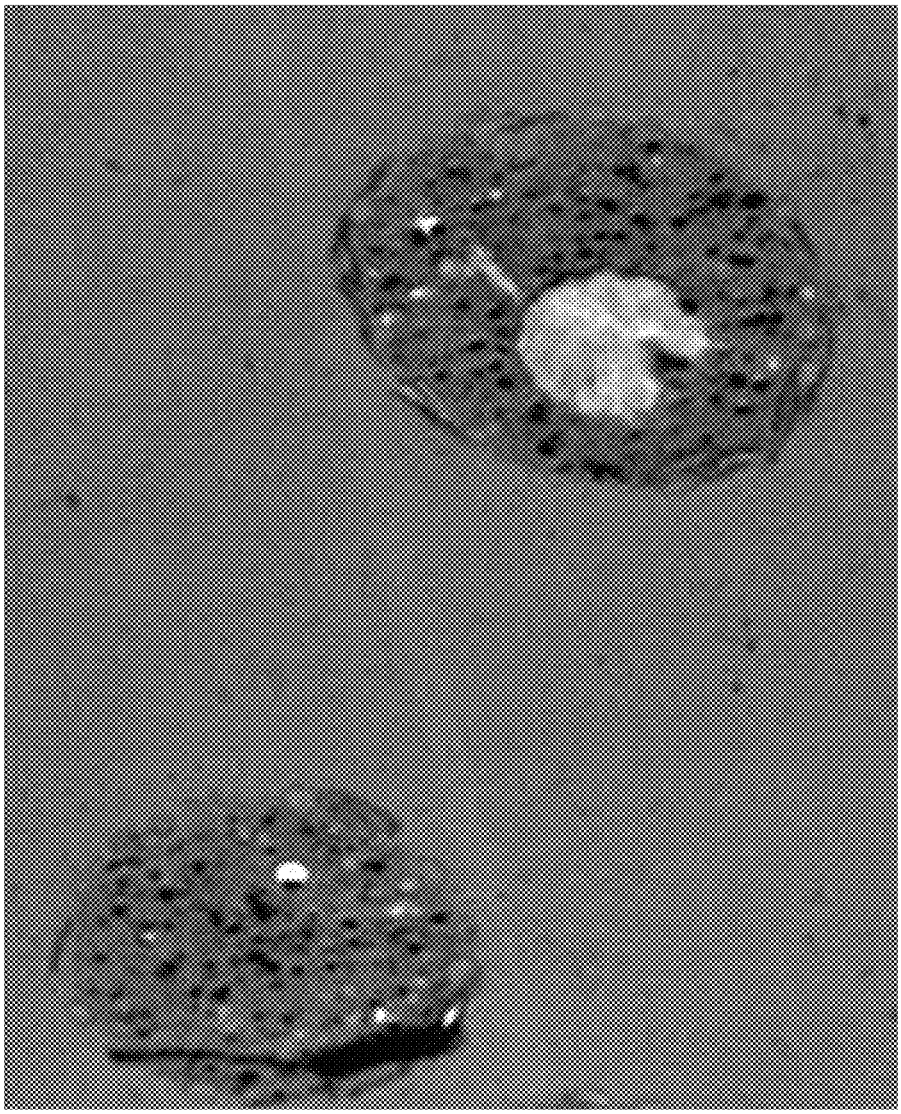
FIG. 2 is a cross-sectional image of the toner according to an embodiment of the present invention, obtained with scanning transmission electron microscope (STEM)

FIG. 2 is a STEM image of a cross-section of toner particles. The toner particle on the upper side contains release agent and that on the lower side contains no release agent or does not satisfy the formula (2).

Evaluation Methods

Developing Durability

An externally-treated toner (developer) in an amount of 100 g is mounted on a modified machine of IPSIO SPC220 (from Ricoh Co., Ltd.), and a predetermined print pattern having a print ratio of 1% is continuously printed on sheets under an N/N environment (i.e., 23° C., 45%). After being printed on 2,000 sheets under the N/N environment, the print pattern is continuously printed on 2,000 sheets under an H/H environment (i.e., 27° C., 80%) in the same manner. Thereafter, a black solid image and a white blank image are printed and evaluated.

A: No image defect is observed in both the black solid image and white blank image.

B: Several white stripes are observed in the black solid image and several toner-colored stripes are observed in the white blank image.

C: White stripes are observed in the black solid image and toner-colored stripes are observed in the white blank image. The total number of both of the stripes is 10 or more.

Fixability

An externally-treated toner (developer) is mounted on a modified machine of IPSIO SPC220 (from Ricoh Co., Ltd.), and an unfixed band-like solid image having a width of 36 mm (having a deposit amount of 11 g/m$^2$) is formed on A4-size paper sheets 3 mm apart from the leading edge of each sheet in a longitudinal direction. The unfixed images are fixed by the below-described fixing device at fixing temperatures ranging from 120 to 170° C. at intervals of 10° C. to determine separable/non-offset temperature range. The separable/non-offset temperature range is defined as a temperature range within which paper sheets are well separable from the heat roller without causing offset. The paper sheet in use is a grain short paper having a basis weight of 45 g/m$^2$ and the paper feeding direction coincides with a longitudinal direction. These conditions are disadvantageous in terms of separability. The peripheral speed of the fixing device is set to 200 mm/sec.

The fixing device has a configuration as illustrated in FIG. 4 which includes a soft roller having a fluorine-based surface layer. Specifically, the heat roller 9 has an outer diameter of 40 mm. On the aluminum cored bar 10, the elastic body layer 11 composed of a silicone rubber having a thickness of 1.5 mm and the surface layer 12 composed of PFA (i.e., tetrafluoroethylene-perfluoroalkylvinyl ether copolymer) are provided. The heater 13 is contained in the aluminum cored bar 10. The pressure roller 14 has an outer diameter of 40 mm. On the aluminum cored bar 15, the elastic body layer 16 composed of a silicone rubber having a thickness of 1.5 mm and the surface layer 17 composed of PFA are provided. A sheet of recording paper P having an unfixed toner image 18 thereon is allowed to pass as illustrated in FIG. 4.

Fixability is evaluated based on the following criteria.

Evaluation Criteria

AA: The separable/non-offset temperatures range from 120 to 170° C., and the fixed image is sufficient in resistance.

A: The separable/non-offset temperatures range at least from 130 to 170° C., and the fixed image is sufficient in resistance.

B: The separable/non-offset temperatures range at least from 140 to 170° C., and the fixed image is sufficient in resistance.

C: The separable/non-offset temperatures do not range at least from 140 to 170° C., and the fixed image is insufficient in resistance.

Preparation methods of raw materials of the toners are described below.

Synthesis of Amorphous Polyester

Polyester 1

A reaction vessel equipped with a condenser, a stirrer, and a nitrogen inlet pipe is charged with 1,195 parts of ethylene oxide 2 mol adduct of bisphenol A, 2,765 parts of propylene oxide 3 mol adduct of bisphenol A, 900 parts of terephthalic acid, 200 parts of adipic acid, and 10 parts of dibutyltin oxide. The mixture is subjected to a reaction at 230° C. for 8 hours under normal pressures and subsequent 5 hours under reduced pressures of from 10 to 15 mmHg. After adding 220 parts of trimellitic anhydride to the vessel, the mixture is further subjected to a reaction at 180° C. for 2 hours under normal pressures. Thus, a polyester 1 is prepared. The polyester 1 has a number average molecular weight of 2,500, a weight average molecular weight of 6,500, a Tg of 47° C., and an acid value of 18.

Polyester 2

A reaction vessel equipped with a condenser, a stirrer, and a nitrogen inlet pipe is charged with 264 parts of ethylene oxide 2 mol adduct of bisphenol A, 523 parts of propylene oxide 2 mol adduct of bisphenol A, 123 parts of terephthalic acid, 173 parts of adipic acid, and 1 part of dibutyltin oxide. The mixture is subjected to a reaction at 230° C. for 8 hours under normal pressures and subsequent 8 hours under reduced pressures of from 10 to 15 mmHg. After adding 26 parts of trimellitic anhydride to the vessel, the mixture is further subjected to a reaction at 180° C. for 2 hours under normal pressures. Thus, a polyester 2 is prepared. The polyester 2 has a number average molecular weight of 4,000, a weight average molecular weight of 47,000, a Tg of 65° C., and an acid value of 12.

Synthesis of Crystalline Polyester

Polyester 3

A reaction vessel equipped with a condenser, a stirrer, and a nitrogen inlet pipe is charged with 500 parts of 1,6-hexanediol, 500 parts of succinic acid, and 2.5 parts of dibutyltin oxide. The mixture is subjected to a reaction at 200° C. for 8 hours under normal pressures and subsequent 1 hour under reduced pressures of from 10 to 15 mmHg. Thus, a polyester 3 is prepared. The polyester 3 has an endothermic peak at 65° C. in DSC measurement.

Release-Agent-Containing Resin W1

A dropping funnel is charged with vinyl monomers including 600 parts of styrene, 110 parts of butyl acrylate, and 30 parts of acrylic acid, and 30 parts of dicumyl peroxide serving as a polymerization initiator.

A 5-liter four-neck flask equipped with a thermometer, a stainless-steel stirrer, a falling-type condenser, and a nitrogen inlet pipe is charged with polyester monomers including 1,230 parts of polyoxypropylene(2.2)-2,2-bis(4-hydroxyphenyl)propane, 290 parts of polyoxyethylene(2.2)-2,2-bis(4-hydroxyphenyl)propane, 250 parts of isododecenyl succinic anhydride, 310 parts of terephthalic acid, and 180 parts of 1,2,4-benzenetricarboxylic anhydride, 330 parts of paraffin wax (having a melting point of 72° C.), and 7 parts of dibutyltin oxide serving as an esterification catalyst. The flask contents are stirred at 160° C. under nitrogen atmosphere in a mantle heater, and the mixture liquid of the vinyl monomers and the polymerization initiator is dropped therein from the dropping funnel over a period of 1 hour.

The flask contents are subjected to an addition polymerization reaction for 2 hours at 160° C. and then heated to 230° C. to cause a polycondensation reaction.

The degree of polymerization is traced by measuring the softening point with a constant-load extrusion capillary rheometer. As the softening point reaches a desired temperature, the reaction is terminated. Thus, a release-agent-containing resin W1 is obtained.

The release-agent-containing resin W1 has a softening point (T1/2) of 130° C.

Release-agent-Containing Resin W2

A dropping funnel is charged with vinyl monomers including 540 parts of styrene, 100 parts of butyl acrylate, and 27 parts of acrylic acid, and 27 parts of dicumyl peroxide serving as a polymerization initiator.

A 5-liter four-neck flask equipped with a thermometer, a stainless-steel stirrer, a falling-type condenser, and a nitrogen inlet pipe is charged with polyester monomers including 1,230 parts of polyoxypropylene(2.2)-2,2-bis(4-hydroxyphenyl)propane, 290 parts of polyoxyethylene(2.2)-2,2-bis(4-hydroxyphenyl)propane, 250 parts of isododecenyl succinic anhydride, 310 parts of terephthalic acid, and 180 parts of 1,2,4-benzenetricarboxylic anhydride, 320 parts of paraffin wax (having a melting point of 72° C.), and 7 parts of dibutyltin oxide serving as an esterification catalyst. The flask contents are stirred at 160° C. under nitrogen atmosphere in a mantle heater, and the mixture liquid of the vinyl monomers and the polymerization initiator is dropped therein from the dropping funnel over a period of 1 hour.

The flask contents are subjected to an addition polymerization reaction for 2 hours at 160° C. and then heated to 230° C. to cause a polycondensation reaction.

The degree of polymerization is traced by measuring the softening point with a constant-load extrusion capillary rheometer. As the softening point reaches a desired temperature, the reaction is terminated. Thus, a release-agent-containing resin W2 is obtained.

The release-agent-containing resin W2 has a softening point (T1/2) of 130° C.

Preparation of Fine Resin Particle Dispersion Liquid

Fine Vinyl Copolymer Resin Particle Dispersion Liquid V-1

A reaction vessel equipped with a condenser, a stirrer, and a nitrogen inlet pipe is charged with 1.6 parts of sodium dodecyl sulfate and 492 parts of ion-exchange water. After being heated to 80° C., the vessel is further charged with a solution in which 2.5 parts of potassium persulfate are dissolved in 100 parts of ion-exchange water. Fifteen minutes later, a mixture liquid including 170 parts of styrene monomer, 30 parts of n-butyl acrylate, and 3.5 parts of n-octyl mercaptan is dropped in the vessel over a period of 90 minutes. The vessel is kept at 80° C. for subsequent 60 minutes. The vessel is cooled to obtain a fine vinyl copolymer resin particle dispersion liquid V-1. The dispersion liquid contains 25% of solid contents. The fine particles have a volume average particle diameter of 110 nm. A small amount of the dispersion liquid is put on a petri dish to vaporize the dispersion solvent. The solid residue has a number average molecular weight of 20,000, a weight average molecular weight of 36,000, and a Tg of 67° C.

Preparation of Master Batch

First, 40 parts of a carbon black (REGAL® 400R from Cabot Corporation), 60 parts of a polyester binder resin (RS-801 from Sanyo Chemical Industries, Ltd., having an acid value of 10, an Mw of 20,000, and a Tg of 64° C.), and 30 parts of water are mixed by a HENSCHEL MIXER to obtain a mixture that is a pigment aggregation into which water is penetrated. The mixture is kneaded with a double roll having a surface temperature of 130° C. for 45 minutes. The kneaded mixture is pulverized by a pulverizer into particles having a diameter of 1 mm. Thus, a master batch 1 is prepared.

Example 1

Preparation of Oily Phase

A vessel equipped with a stirrer and a thermometer is charged with 12 parts of the polyester 1, 20 parts of the polyester 3, and 96 parts of ethyl acetate. The mixture is stirred for 5 hours. After adding 35 parts of the master batch 1 to the vessel and stirring the mixture for 1 hour, the mixture is transferred to another vessel and is subjected to a dispersion treatment using a bead mill (ULTRAVISCO-MILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a raw material liquid 1 is prepared. Next, 74.1 parts of a 70% ethyl acetate solution of the release-agent-containing resin W1, 21.6 parts of the polyester 1, and 21.5 parts of ethyl acetate are added to 81.3 parts of the raw material liquid 1. The mixture is stirred with a THREE-ONE MOTOR for 2 hours. Thus, an oily phase 1 is prepared. The solid content concentration (measured at 130° C. for 30 minutes) of the oily phase 1 is adjusted to 49% by addition of ethyl acetate.

Preparation of Aqueous Phase

An aqueous phase 1 is prepared by mixing and stirring 408 parts of ion-exchange water, 81 parts of a 50% aqueous solution of dodecyl diphenyl ether sodium disulfonate (ELEMINOL MON-7 from Sanyo Chemical Industries, Ltd.), 67 parts of a 1% aqueous solution of carboxymethylcellulose serving as a thickener, 16 parts of a 20% aqueous dispersion liquid of fine organic resin particles (i.e., a copolymer of styrene, methacrylic acid, butyl acrylate, sodium salt of sulfate ester of ethylene oxide adduct of methacrylic acid) for dispersion stability, 11 parts of a 4% aqueous solution of sodium hydroxide, and 54 parts of ethyl acetate. At the time the fine organic resin particles are added, the mixture expresses yellowish milky white color. Immediately after sodium hydroxide is mixed therein, the mixture is changed into a yellowish transparent liquid. The mixture has a pH of 9.3.

Emulsification

The oily phase 1 is stirred with a TK HOMOMIXER (from Primix Corporation) at a revolution of 5,000 rpm. After adding 321 parts of the aqueous phase 1, the resulting mixture is stirred with a TK HOMOMIXER at a revolution of from 8,000 to 13,000 rpm. Thus, a slurry 1 is prepared.

Solvent Removal

The slurry 1 is contained in a vessel equipped with a stirrer and a thermometer and subjected to solvent removal at 30° C. for 8 hours. Thus, a dispersion slurry 1 is prepared.

Washing and Drying

After filtering 100 parts of the dispersion slurry 1 under reduced pressure:

(1) 100 parts of ion-exchange water are added to the resulting filter cake, and they are mixed by a TK HOMOMIXER at a revolution of 12,000 rpm for 10 minutes, followed by filtering;

(2) 100 parts of ion-exchange water are added to the filter cake obtained in (1), and they are mixed by a TK HOMOMIXER at a revolution of 12,000 rpm for 30 minutes while applying ultrasonic vibration thereto, followed by filtering. This operation is repeated until the re-slurry liquid exhibits an electric conductivity of 10 μS/cm or less;

(3) A 10% solution of hydrochloric acid is added to the re-slurry liquid obtained in (2) until the re-slurry liquid exhibits a pH of 4. The mixture is stirred by a THREE-ONE MOTOR for 30 minutes, followed by filtering; and (4) 100 parts of ion-exchange water are added to the filter cake obtained in (3), and they are mixed by a TK HOMOMIXER at a revolution of 12,000 rpm for 10 minutes, followed by filtering. This operation is repeated until the re-slurry liquid exhibits an electric conductivity of 10 μS/cm or less. Thus, a filter cake 1 is obtained.

The rest of the dispersion slurry 1 is washed in the same manner as above and the resulting filter cake is mixed in the filter cake 1.

The filter cake 1 is dried by a circulating air dryer at 45° C. for 48 hours and then filtered with a mesh having openings of 75 μm. Thus, a mother toner 1 is prepared. The mother toner 1 in an amount of 50 parts is mixed with 1 part of a hydrophobized silica having a primary particle diameter of about 30 nm and 0.5 parts of a hydrophobized silica having a primary particle diameter of about 10 nm by a HENSCHEL MIXER. Thus, a developer 1 is prepared.

Example 2

Preparation of Oily Phase

First, 105 parts of a 70% ethyl acetate solution of the release-agent-containing resin W1 and 21.5 parts of ethyl acetate are added to 81.3 parts of the raw material liquid 1. The mixture is stirred with a TIIREE-ONE MOTOR for 2 hours. Thus, an oily phase 2 is prepared. The solid content concentration (measured at 130° C. for 30 minutes) of the oily phase 2 is adjusted to 49% by addition of ethyl acetate.

Emulsification

The oily phase 2 is stirred with a TK HOMOMIXER (from Primix Corporation) at a revolution of 5,000 rpm. After adding 321 parts of the aqueous phase 1, the resulting mixture is stirred with a TK HOMOMIXER at a revolution of from 8,000 to 13,000 rpm. Thus, a core particle slurry 2 is prepared.

Shell Formation (Adherence/Half-Embedding of Fine Resin Particles to/in Core Particle)

The core particle slurry 2 is quickly set to a THREE-ONE MOTOR equipped with an anchor blade. The THREE-ONE MOTOR starts stirring the core particle slurry 2 at a revolution of 200 rpm. The fine vinyl copolymer resin particle dispersion liquid V-1 in an amount of 21.4 parts is dropped therein over a period of 1 minute. The mixture is being stirred for 30 minutes. A small amount of the slurry is collected and diluted with 10 times that of water. As a result of centrifugal separation by a centrifugal separator, mother toner particles settle out at the bottom of a test tube while the supernatant liquid being substantially transparent. Thus, a shell-formed slurry 2 is obtained.

Solvent Removal

The shell-formed slurry 2 is contained in a vessel equipped with a stirrer and a thermometer and subjected to solvent removal at 30° C. for 8 hours. Thus, a dispersion slurry 2 is prepared. Then, the procedure in Example 1 is repeated to obtain a developer 2.

Example 3

Preparation of Oily Phase

First, 74.1 parts of a 70% ethyl acetate solution of the release-agent-containing resin W2, 21.6 parts of the polyester 1, and 21.5 parts of ethyl acetate are added to 81.3 parts of the raw material liquid 1. The mixture is stirred with a THREE-ONE MOTOR for 2 hours. Thus, an oily phase 3 is prepared. The solid content concentration (measured at 130° C. for 30 minutes) of the oily phase 3 is adjusted to 49% by addition of ethyl acetate. Then, the procedure in Example 1 is repeated to obtain a developer 3.

Example 4

Preparation of Oily Phase

First, 105 parts of a 70% ethyl acetate solution of the release-agent-containing resin W2 and 21.5 parts of ethyl acetate are added to 81.3 parts of the raw material liquid 1. The mixture is stirred with a THREE-ONE MOTOR for 2 hours. Thus, an oily phase 4 is prepared. The solid content concentration (measured at 130° C. for 30 minutes) of the oily phase 4 is adjusted to 49% by addition of ethyl acetate.

Then, the procedure in Example 2 is repeated to obtain a developer 4.

Example 5

Preparation of Oily Phase

A vessel equipped with a stirrer and a thermometer is charged with 12 parts of the polyester 1, 20 parts of the polyester 3, and 96 parts of ethyl acetate. The mixture is stirred for 5 hours. After adding 35 parts of the master batch 1 to the vessel and stirring the mixture for 1 hour, the mixture is transferred to another vessel and is subjected to a dispersion treatment using a bead mill (ULTRAVISCO-MILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a raw material liquid 1 is prepared. Next, 74.1 parts of a 70% ethyl acetate solution of the release-agent-containing resin W1, 21.6 parts of the polyester 1, and 21.5 parts of ethyl acetate are added to 81.3 parts of the raw material liquid 1. The mixture is stirred with a THREE-ONE MOTOR for 2 hours. Thus, an oily phase 1 is prepared. The solid content concentration (measured at 130° C. for 30 minutes) of the oily phase 1 is adjusted to 49% by addition of ethyl acetate.

Emulsification

The oily phase 1 is stirred with a TK HOMOMIXER (from Primix Corporation) at a revolution of 5,000 rpm. After adding 321 parts of the aqueous phase 1, the resulting mixture is stirred with a TK HOMOMIXER at a revolution of from 8,000 to 13,000 rpm. Thus, a core particle slurry 5 is prepared.

Shell Formation (Adherence/Half-Embedding of Fine Resin Particles to/in Core Particle)

The core particle slurry 5 is quickly set to a THREE-ONE MOTOR equipped with an anchor blade. The THREE-ONE MOTOR starts stirring the core particle slurry 5 at a revolution of 200 rpm. The fine vinyl copolymer resin particle dispersion liquid V-1 in an amount of 21.4 parts is dropped therein over a period of 1 minute. The mixture is being stirred for 30 minutes. A small amount of the slurry is collected and diluted with 10 times that of water. As a result of centrifugal separation by a centrifugal separator, mother toner particles settle out at the bottom of a test tube while the supernatant liquid being substantially transparent. Thus, a shell-formed slurry 5 is obtained.

Then, the procedure in Example 2 is repeated to obtain a developer 5.

Example 6

Preparation of Oily Phase

First, 74.1 parts of a 70% ethyl acetate solution of the release-agent-containing resin W2, 21.6 parts of the polyester 1, and 21.5 parts of ethyl acetate are added to 81.3 parts of the raw material liquid 1. The mixture is stirred with a THREE-ONE MOTOR for 2 hours. Thus, an oily phase 3 is prepared. The solid content concentration (measured at 130° C. for 30 minutes) of the oily phase 4 is adjusted to 49% by addition of ethyl acetate.

Emulsification

The oily phase 3 is stirred with a TK HOMOMIXER (from Primix Corporation) at a revolution of 5,000 rpm. After adding 321 parts of the aqueous phase 1, the resulting mixture is stirred with a TK HOMOMIXER at a revolution of from 8,000 to 13,000 rpm. Thus, a core particle slurry 6 is prepared.

Shell Formation (Adherence/Half-Embedding of Fine Resin Particles to/in Core Particle)

The core particle slurry 6 is quickly set to a THREE-ONE MOTOR equipped with an anchor blade. The THREE-ONE MOTOR starts stirring the core particle slurry 6 at a revolution of 200 rpm. The fine vinyl copolymer resin particle dispersion liquid V-1 in an amount of 21.4 parts is dropped therein over a period of 1 minute. The mixture is being stirred for 30 minutes.

A small amount of the slurry is collected and diluted with 10 times that of water. As a result of centrifugal separation by a centrifugal separator, mother toner particles settle out at the bottom of a test tube while the supernatant liquid being substantially transparent. Thus, a shell-formed slurry 6 is obtained. Then, the procedure in Example 2 is repeated to obtain a developer 6.

Comparative Example 1

Preparation of Oily Phase

First, 105 parts of a 70% ethyl acetate solution of the release-agent-containing resin W1 and 21.5 parts of ethyl acetate are added to 81.3 parts of the raw material liquid 1. The mixture is stirred with a THREE-ONE MOTOR for 2 hours. Thus, an oily phase R1 is prepared. The solid content concentration (measured at 130° C. for 30 minutes) of the oily phase R1 is adjusted to 49% by addition of ethyl acetate.

Then, the procedure in Example 1 is repeated to obtain a developer R1.

Comparative Example 2

Preparation of Oily Phase

First, 50 parts of a 70% ethyl acetate solution of the release-agent-containing resin W2, 38.5 parts of the polyester 1, and 21.5 parts of ethyl acetate are added to 81.3 parts of the raw material liquid 1. The mixture is stirred with a THREE-ONE MOTOR for 2 hours. Thus, an oily phase R2 is prepared. The solid content concentration (measured at 130° C. for 30 minutes) of the oily phase R2 is adjusted to 49% by addition of ethyl acetate.

Then, the procedure in Example 1 is repeated to obtain a developer R2.

Comparative Example 3

Preparation of Oily Phase

A reaction vessel equipped with a stirrer and a thermometer is charged with 2 parts of the polyester 1, 10 parts of a paraffin wax (having a melting point of 72° C.), and 96 parts of ethyl acetate. The mixture is heated to 80° C. while being stirred, kept at 80° C. for 5 hours, and cooled to 30° C. over a period of 1 hour. After adding 20 parts of the polyester 3 and 35 parts of the master batch 1 to the vessel and stirring the mixture for 1 hour, the mixture is transferred to another vessel and is subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 2 times (2 passes). Thus, a raw material liquid R3 is prepared. Next, 74.1 parts of a 70% ethyl acetate solution of the polyester 1, 21.6 parts of the polyester 2, and 21.5 parts of ethyl acetate are added to 81.3 parts of the raw material liquid R3. The mixture is stirred with a THREE-ONE MOTOR for 2 hours. Thus, an oily phase R3 is prepared. The solid content concentration (measured at 130° C. for 30 minutes) of the oily phase R3 is adjusted to 49% by addition of ethyl acetate.

Then, the procedure in Example 1 is repeated to obtain a developer R3.

Comparative Example 4

Preparation of Oily Phase

A reaction vessel equipped with a stirrer and a thermometer is charged with 6 parts of the polyester 1, 6 parts of a paraffin wax (having a melting point of 72° C.), and 96 parts of ethyl acetate. The mixture is heated to 80° C. while being stirred, kept at 80° C. for 5 hours, and cooled to 30° C. over a period of 1 hour. After adding 20 parts of the polyester 3 and 35 parts of the master batch 1 to the vessel and stirring the mixture for 1 hour, the mixture is transferred to another vessel and is subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a raw material liquid R4 is prepared. Next, 74.1 parts of a 70% ethyl acetate solution of the polyester 1, 21.6 parts of the polyester 2, and 21.5 parts of ethyl acetate are added to 81.3 parts of the raw material liquid R4. The mixture is stirred with a THREE-ONE MOTOR for 2 hours. Thus, an oily phase R4 is prepared. The solid content concentration (measured at 130° C. for 30 minutes) of the oily phase R4 is adjusted to 49% by addition of ethyl acetate.

Then, the procedure in Example 1 is repeated to obtain a developer R4.

The compositions of the above-prepared developers are shown in Table 1.

The properties and evaluation results of the above-prepared developers are shown in Tables 2-1 and 2-2.

TABLE 1

| | Developer | Release-agent-containing Resin | Release Agent | Polyester 1 | Polyester 2 | Polyester 3 | Fine Vinyl Copolymer Resin Particle Dispersion Liquid V-1 |
|---|---|---|---|---|---|---|---|
| Example 1 | 1 | W1 | — | Yes | — | Yes | — |
| Example 2 | 2 | W1 | — | Yes | — | Yes | Yes |
| Example 3 | 3 | W2 | — | Yes | — | Yes | — |
| Example 4 | 4 | W2 | — | Yes | — | Yes | Yes |
| Example 5 | 5 | W1 | — | Yes | — | Yes | Yes |
| Example 6 | 6 | W2 | — | Yes | — | Yes | Yes |
| Comparative Example 1 | R1 | W1 | — | Yes | — | Yes | — |
| Comparative Example 2 | R2 | W2 | — | Yes | — | Yes | — |
| Comparative Example 3 | R3 | — | Paraffin | Yes | Yes | Yes | — |
| Comparative Example 4 | R4 | — | Paraffin | Yes | Yes | Yes | — |

TABLE 2-1

| | | Means For Adding Release Agent | | Toner Properties | | | |
|---|---|---|---|---|---|---|---|
| | Developer | Release-agent-containing Resin | Release Agent Dispersion Liquid | Particle Diameter Dv | Dn | Dv/Dn | Average Circularity |
| Example 1 | 1 | W1 | — | 6.4 | 5.7 | 1.12 | 0.980 |
| Example 2 | 2 | W1 | — | 6.5 | 5.7 | 1.14 | 0.985 |
| Example 3 | 3 | W2 | — | 7.9 | 6.8 | 1.16 | 0.971 |
| Example 4 | 4 | W2 | — | 4.6 | 3.9 | 1.18 | 0.989 |
| Example 5 | 5 | W1 | — | 6.5 | 5.7 | 1.14 | 0.978 |
| Example 6 | 6 | W2 | — | 7.0 | 6.1 | 1.15 | 0.973 |
| Comparative Example 1 | R1 | W1 | — | 6.3 | 5.6 | 1.13 | 0.982 |
| Comparative Example 2 | R2 | W2 | — | 6.0 | 5.3 | 1.13 | 0.983 |
| Comparative Example 3 | R3 | — | Yes | 6.5 | 5.7 | 1.14 | 0.981 |
| Comparative Example 4 | R4 | — | Yes | 7.5 | 6.5 | 1.15 | 0.984 |

TABLE 2-2

| | Ratio of Toner Particles Satisfying Formula (2) % by number | Release Agent Shape Factor SF-1 | Evaluation Results Fixability | Developing Durability |
|---|---|---|---|---|
| Example 1 | 42 | 116 | A | A |
| Example 2 | 78 | 125 | AA | A |
| Example 3 | 21 | 130 | A | A |
| Example 4 | 65 | 139 | AA | A |
| Example 5 | 40 | 117 | A | A |
| Example 6 | 25 | 132 | A | A |
| Comparative Example 1 | 82 | 128 | AA | C |
| Comparative Example 2 | 19 | 142 | C | A |
| Comparative Example 3 | 52 | 198 | B | C |
| Comparative Example 4 | 18 | 181 | C | B |

These tables show that the toner according to some embodiments of the present invention deliver good results while the comparative toners cannot achieve a good balance between fixability and developing durability.

What is claimed is:

1. A toner, comprising:

an external additive; and mother toner particles, comprising:

a binder resin;

a release agent; and a plurality of fine resin particles on the mother toner particle surface, each fine resin particle composed of a vinyl polymeric resin;

wherein when a plurality of the toner particles are observed in a scanning transmission electron microscope a first amount by number of the toner particles satisfy formula (1) and a second amount by number of the toner particles satisfying formula (1) also satisfy formula (2) and a number % of the amount of second toner particles of the first amount of toner particles is from 20% to 80%:

$$2/3 \leq T/Dv \leq 1.5 \quad (1)$$

$$1/3 \leq R/Dv \leq 1.0 \quad (2)$$

wherein Dv represents a volume average particle diameter of the toner particles; and T and R represent the longest cross-sectional diameters of each toner particle and the release agent contained therein, respectively, measured by observing cross-sections of the toner particles with scanning transmission electron microscope, and wherein the mother particle has a sea-island structure in which the fine resin particles serve as island portions and constituents other than the fine resin particles serve as sea portions.

2. The toner according to claim 1, wherein the release agent contained in each cross-section of the toner particles has a shape factor SF-1 of from 100 to 140.

3. The toner according to claim 1, wherein the toner particles have an average circularity of 0.96 or more.

4. The toner according to claim 1, wherein each fine resin particle is half embedded in the surface of the mother particle to form surface asperity thereon.

5. The toner according to claim 1, wherein the binder resin comprises a polyester-vinyl hybrid resin.

6. A developing device, comprising:

a developer bearer having a surface in contact with the toner according to claim 1 to be supplied to a latent image bearer; and a developer supply member to supply the toner to the surface of the developer bearer.

7. A process cartridge detachably mountable on an image forming apparatus, comprising:

a latent image bearer to bear a latent image; and the developing device according to claim 6 to develop the latent image with the toner.

* * * * *